US006877806B2

(12) United States Patent
Cutshall et al.

(10) Patent No.: US 6,877,806 B2
(45) Date of Patent: Apr. 12, 2005

(54) FOLDING TRAY ASSEMBLY

(75) Inventors: Mark L. Cutshall, Livonia, MI (US); Joe Parker, Fowlerville, MI (US); Lawrence Scott, Brighton, MI (US)

(73) Assignee: E & E Manufacturing Company, Inc., Plymouth, MI (US)

( * ) Notice: Subject to any disclaimer, the term of this patent is extended or adjusted under 35 U.S.C. 154(b) by 0 days.

(21) Appl. No.: 10/395,979

(22) Filed: Mar. 25, 2003

(65) Prior Publication Data

US 2004/0075308 A1 Apr. 22, 2004

Related U.S. Application Data

(60) Provisional application No. 60/420,004, filed on Oct. 21, 2002.

(51) Int. Cl.[7] ..... A47B 39/00

(52) U.S. Cl. ..... 297/173; 297/162; 297/188.21; 297/155; 297/161; 108/9

(58) Field of Search ..... 297/162, 173, 297/188.21, 155, 161, 170; 108/1, 6, 7, 9, 42, 152, 193; 248/285.1, 298.2, 286.1, 298.1

(56) References Cited

U.S. PATENT DOCUMENTS

| | | | | | |
|---|---|---|---|---|---|
| 2,723,887 | A | | 11/1955 | Kowalsky | |
| 4,288,123 | A | * | 9/1981 | Cone | 297/154 |
| 4,715,295 | A | * | 12/1987 | Hartman et al. | 108/93 |
| 4,762,258 | A | | 8/1988 | Murphy | |
| 5,143,337 | A | | 9/1992 | Tomayko, Jr. et al. | |
| 5,145,136 | A | * | 9/1992 | McConnell | 248/284.1 |
| 5,169,210 | A | * | 12/1992 | Fricano | 297/188.21 |
| 5,193,695 | A | | 3/1993 | Mann | |
| 5,271,320 | A | * | 12/1993 | Reneau | 100/147 |
| 5,588,697 | A | | 12/1996 | Yoshida et al. | |
| 5,915,657 | A | * | 6/1999 | Ptak | 248/286.1 |
| 6,032,587 | A | | 3/2000 | Salenbauch et al. | |
| 6,038,983 | A | * | 3/2000 | Lendl | 108/44 |
| 6,085,666 | A | | 7/2000 | Anderson et al. | |
| 6,158,359 | A | * | 12/2000 | Allan et al. | 108/93 |
| 6,250,702 | B1 | | 6/2001 | Eipper | |
| 6,273,382 | B1 | * | 8/2001 | Pemberton | 248/286.1 |
| 6,279,992 | B1 | | 8/2001 | Plocher et al. | |
| 6,394,002 | B1 | | 5/2002 | Blanchard et al. | |
| 6,487,979 | B1 | | 12/2002 | Ash et al. | |
| 6,604,783 | B1 | * | 8/2003 | Goodson | 297/170 |
| 6,681,703 | B1 | * | 1/2004 | Wells et al. | 108/20 |
| 2002/0073899 | A1 | | 6/2002 | Chen | |
| 2002/0084395 | A1 | * | 7/2002 | Johnson | 248/276.1 |
| 2002/0108543 | A1 | | 8/2002 | Wiggins | |

* cited by examiner

*Primary Examiner*—Peter M. Cuomo
*Assistant Examiner*—Joseph Edell
(74) *Attorney, Agent, or Firm*—Harness, Dickey & Pierce, PLC

(57) ABSTRACT

A folding tray assembly is provided and includes a support member and a tray member, whereby the tray member is pivotably supported by the support member and moveable relative thereto between a use position and a stowed position. The folding tray assembly further includes a locking mechanism operable to selectively lock the tray member to the support member in one of either the use position or the stowed position. The locking mechanism is housed within the tray member such that the mechanism is not visible or accessible by an occupant, but rather remotely actuated by a handle or lever. In addition, the tray assembly eliminates external supports by providing support within the tray member, thereby providing an open space below the tray member and giving the tray assembly a generally L-shape in the use position.

32 Claims, 23 Drawing Sheets

FOLDING TRAY ASSEMBLY

CROSS-REFERENCE TO RELATED APPLICATIONS

This application claims the benefit of U.S. Provisional Application No. 60/420,004, filed on Oct. 21, 2002. The disclosure(s) of the above application(s) is (are) incorporated herein by reference.

FIELD OF THE INVENTION

The present invention relates to tray assemblies, and more particularly, to folding tray assemblies for use as part of seat assemblies.

BACKGROUND OF THE INVENTION

In seating applications, it is desirable to provide a tray for use by an occupant when eating or drinking. Further, it is desirable that the tray be capable of stowing or folding when not in use to allow an occupant to maximize the space around the seat assembly. Further yet, it is desirable that the tray be capable of supporting relatively large loads such as by way of supporting large beverages or a large purse while not utilizing an external brace or support. Typically, a folding tray assembly is mounted to the side of a seat assembly and pivots between a use position and a stowed position, thus providing the occupant with a flat tray when in the use position.

Conventional tray assemblies are typically mounted to one side of a seat assembly and provide a surface for supporting a drink or a laptop for use by an occupant when using the seat. Typically, the tray surface is supported by a stationary bracket fixedly mounted to either the seat bottom or the seatback. In either case, the tray is commonly connected to the support bracket through a hinge, whereby the tray is able to pivot relative to the support bracket about the hinge. Conventional tray assemblies typically provide for movement between a stowed position and a use position. In the stowed position, the tray folds such that a top surface of the tray runs parallel with the support bracket. When the tray is in the use position, the tray surface is generally perpendicular to the support bracket in an effort to provide a flat surface for use by the occupant.

To maintain the relatively flat surface of the tray while in the use position, conventional tray assemblies provide a locking mechanism that enables the tray to maintain the generally perpendicular relationship with the support bracket. Typically, the locking mechanism includes an external support arm and a linkage, whereby the support arm provides added support for the tray and the linkage allows the support arm to fold flat when the tray is in the stowed position. Such an arrangement is disclosed in U.S. Pat. No. 5,588,697 to Yoshida.

While conventional tray assemblies for use in combination with a seat assembly adequately provide a tray moveable between a stowed position and a use position, conventional tray assemblies suffer from the fact that they require exposed linkages to adequately support the tray surface and pivot about the support bracket. Exposed linkages may become hazardous when actuating the tray assembly between the stowed and use positions, whereby an occupant may inadvertently pinch a finger or snag an article of clothing during use.

Therefore a tray assembly for use with a seat assembly that is movable between a stowed position and a use position that can support a relatively high amount of weight while not requiring exposed links or support structure is desirable in the industry. Further, a tray assembly that includes a locking mechanism housed within the tray is desirable in the industry.

SUMMARY OF THE INVENTION

Accordingly, the present invention provides a folding tray assembly including a support member and a tray member, whereby the tray member is pivotably supported by the support member and moveable relative thereto between a use position and a stowed position. The folding tray assembly further includes a locking mechanism operable to selectively lock the tray member to the support member in one of either the use position or the stowed position. The locking mechanism is housed within the tray assembly such that the mechanism is not visible or accessible by an occupant, but rather remotely actuated by a handle or lever.

In one embodiment, the locking mechanism includes a cam plate in communication with a pair of axially sliding posts, whereby the axially sliding posts act to selectively secure the tray member to the support member. Specifically, while the posts are disposed within the tray member, a pair of clearance holes formed in the tray member allow the posts to engage the support member. In this manner, the posts are the only part of the locking mechanism that extend outside of the tray member. The posts are biased into engagement with the support member by a pair of springs and only disengage the support member though actuation of the cam plate. Specifically, once a force is applied to the cam plate, the posts are caused to move axially into the tray member such that rotation of the tray member relative to the support member is permitted.

In another embodiment, the locking mechanism includes a first and second tube, whereby the first tube is fixedly attached to the tray member and the second tube is fixedly attached to the support member. The first tube rotatably receives the second tube, such that the second tube is permitted to rotate relative the first tube. Rotation of the second tube is governed by a pair of slots formed in the first tube having a generally L-shape, whereby each slot includes a first and second end. Specifically, the second tube includes a pair of posts fixedly attached thereto which are received by the L-shaped slots of the first tube. As the posts move along the slots from the first end to the second end, the tray member moves from the use position to the stowed position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
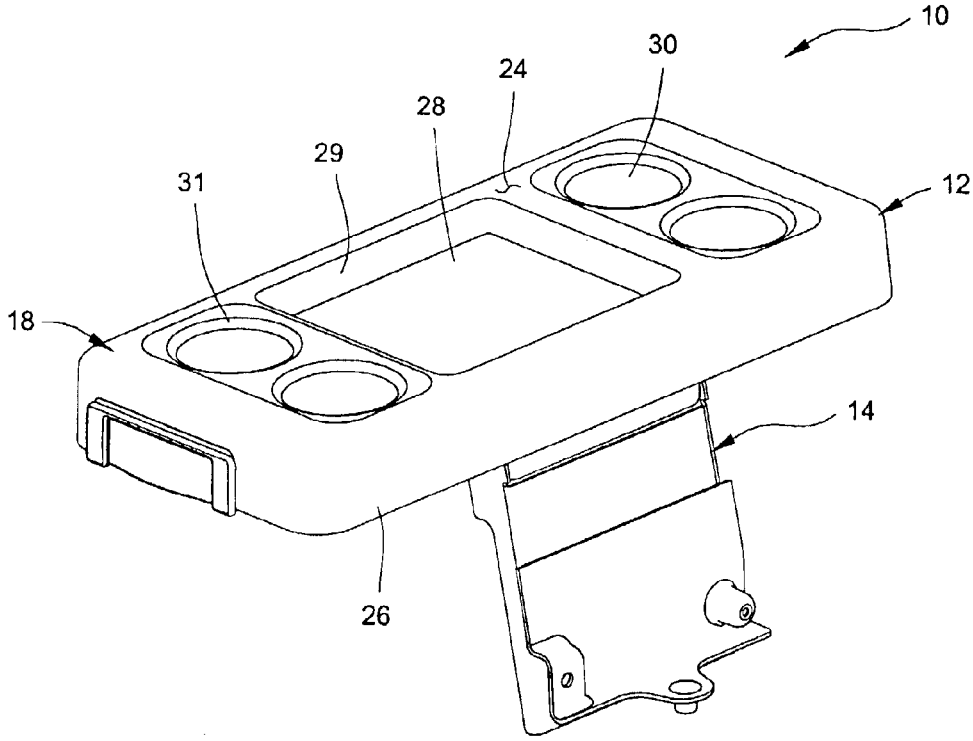
FIG. 1 is a perspective view of a tray assembly in accordance with the principals of the present invention.

The following description of the preferred embodiments is merely exemplary in nature and is in no way intended to limit the invention, its application, or uses.

With reference to the Figures, a folding tray assembly 10 is provided an includes a tray member 12, a support member or bracket 14, and locking mechanism 16. The tray 12 is pivotably supported by the support member 14, and the locking mechanism 16 acts to selectively lock the tray 12 in one of a stowed position or a use position relative to the support member 14.

The tray member 12 includes a cover 18, a base 20, and a reinforcement bracket 22. The cover 18 includes a top surface 24 and a first flange 26, whereby the first flange 26 extends generally perpendicularly from the top surface 24. The first flange 26 generally surrounds the perimeter of the cover 18 with the exception of a cutout 27 for interaction with the base 20, as will be discussed further below. The top surface 24 further includes a central recess 28 and a plurality of cylindrical recesses 30 extending therefrom, whereby the formation of the central and cylindrical recesses 28, 30 in the cover 18 also forms walls 29 and 31, as best shown in FIG. 1. It should be understood that while a central recess 28 and a plurality of cylindrical recesses 30 are disclosed, any recess formed in the cover 18 which generally extends from the top surface 24 is anticipated and should be considered within the scope of the present invention.

In use, the central and cylindrical recesses 28, 30 provide a way for an occupant to store items on the top surface 24 of the cover 18, such as a beverage or a pair of sunglasses (neither shown) due to the relationship of the central and cylindrical recesses 28, 30 to the top surface 24. Specifically, an item placed in either the central or cylindrical recess 28, 30 is restricted from sliding off of the top surface 24 of the cover 18 by the walls 29, 31. The walls 29, 31 act to restrict the movement of the item relative the top surface 24 and thus prevent items from sliding off the cover 18. To that end, the central recess 28 and cylindrical recesses 30 may be optionally provided with a rubber insert or grommet (neither shown) to further secure items disposed in either the central or cylindrical recesses 28, 30.

Figure 2A:
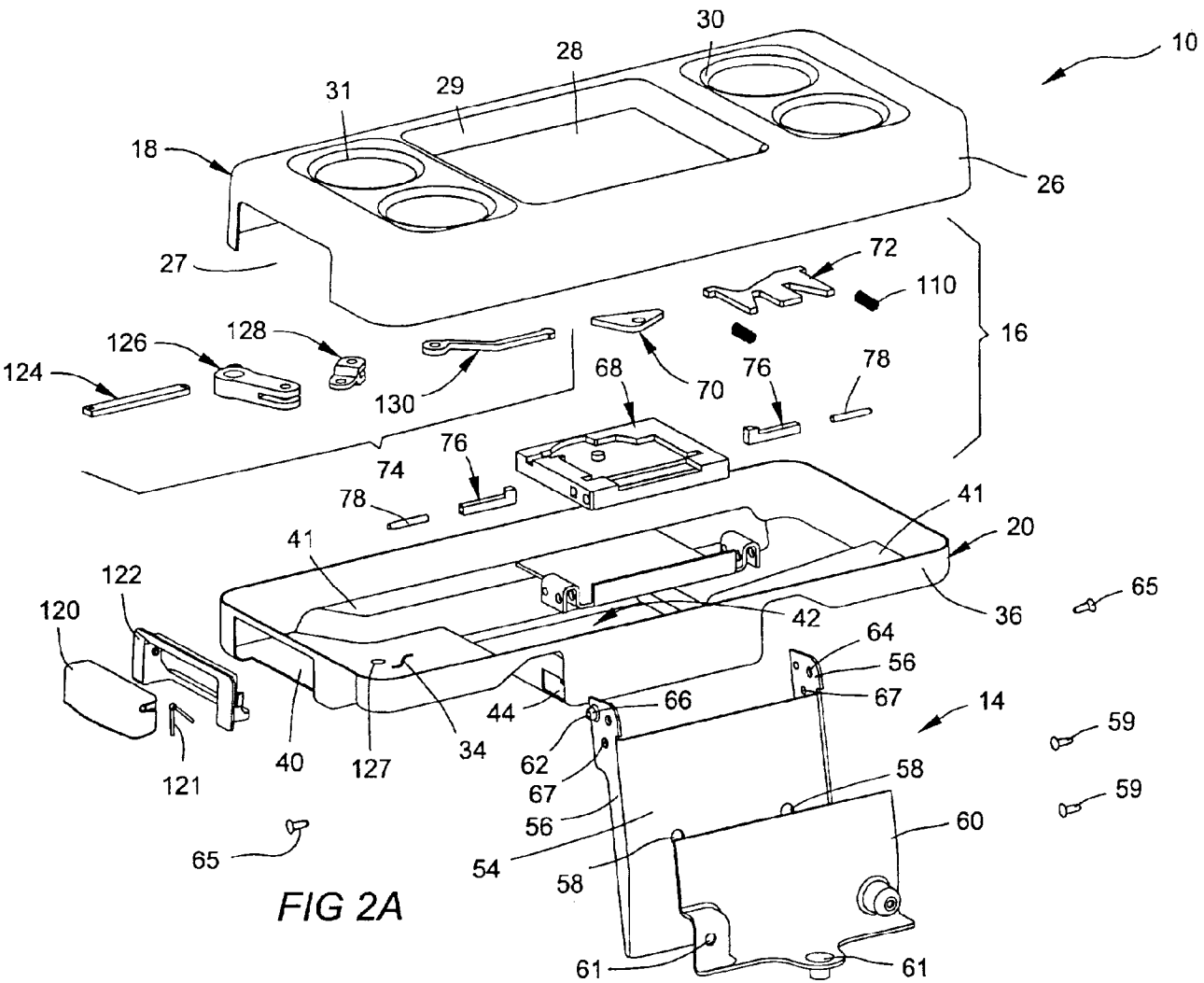
FIG. 2A is an exploded view of the tray assembly of FIG. 1.
Figure 3:
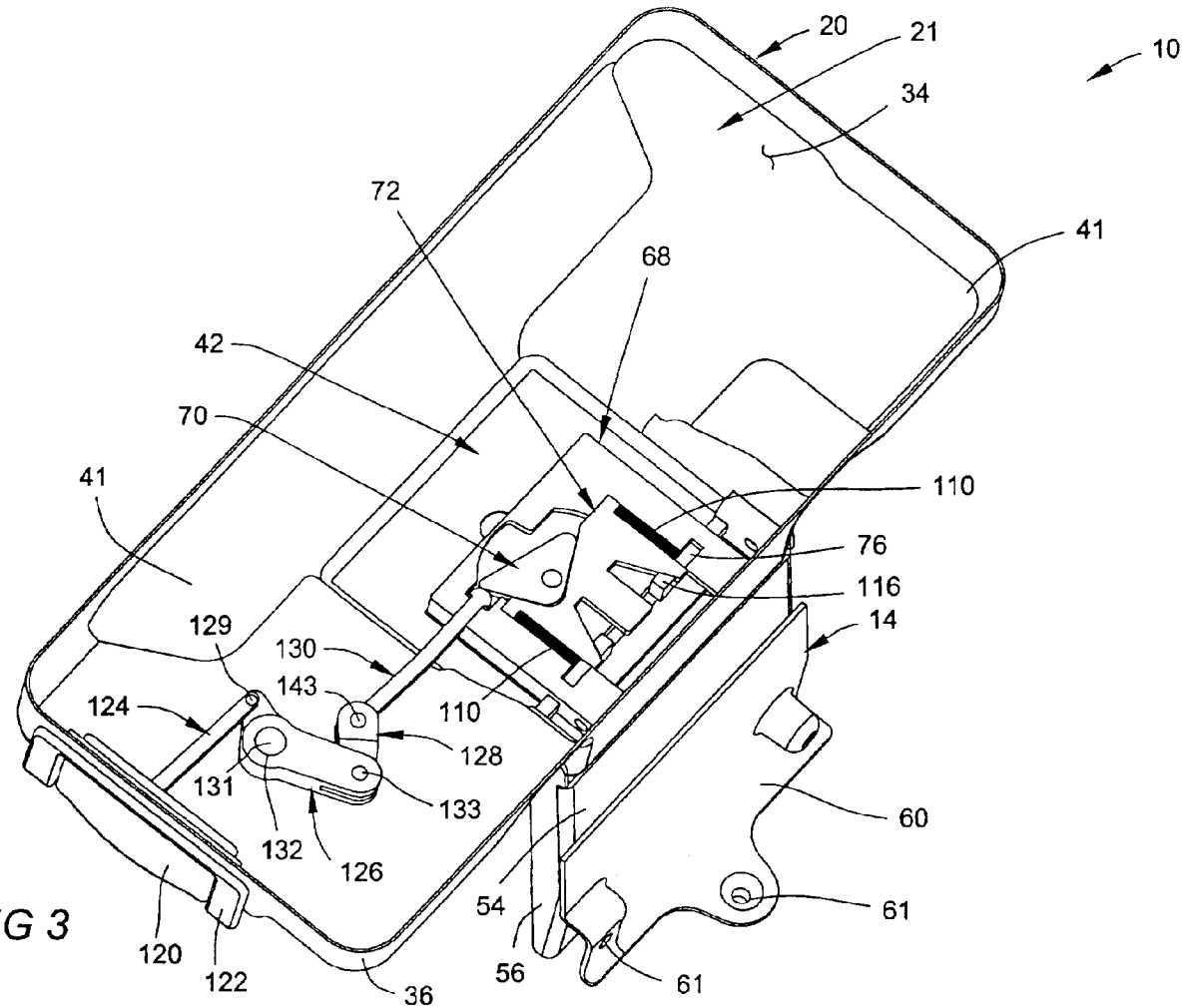
FIG. 3 is a perspective view of the tray assembly with part of a housing removed to show a locking mechanism of the tray assembly in an engaged position.
Figure 4:
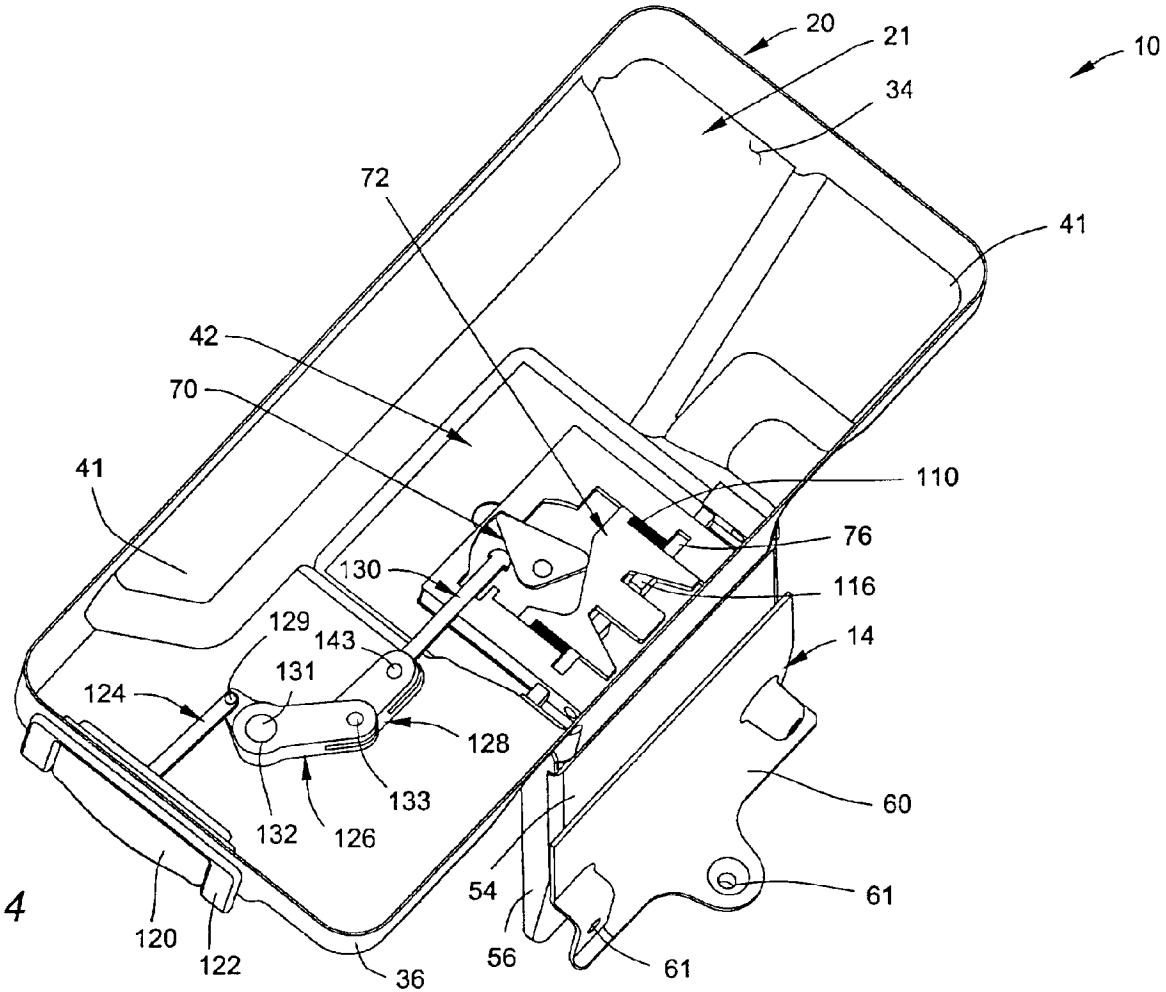
FIG. 4 is a perspective view of the tray assembly with part of a housing removed to show a locking mechanism of the tray assembly in a disengaged position.
Figure 5A:
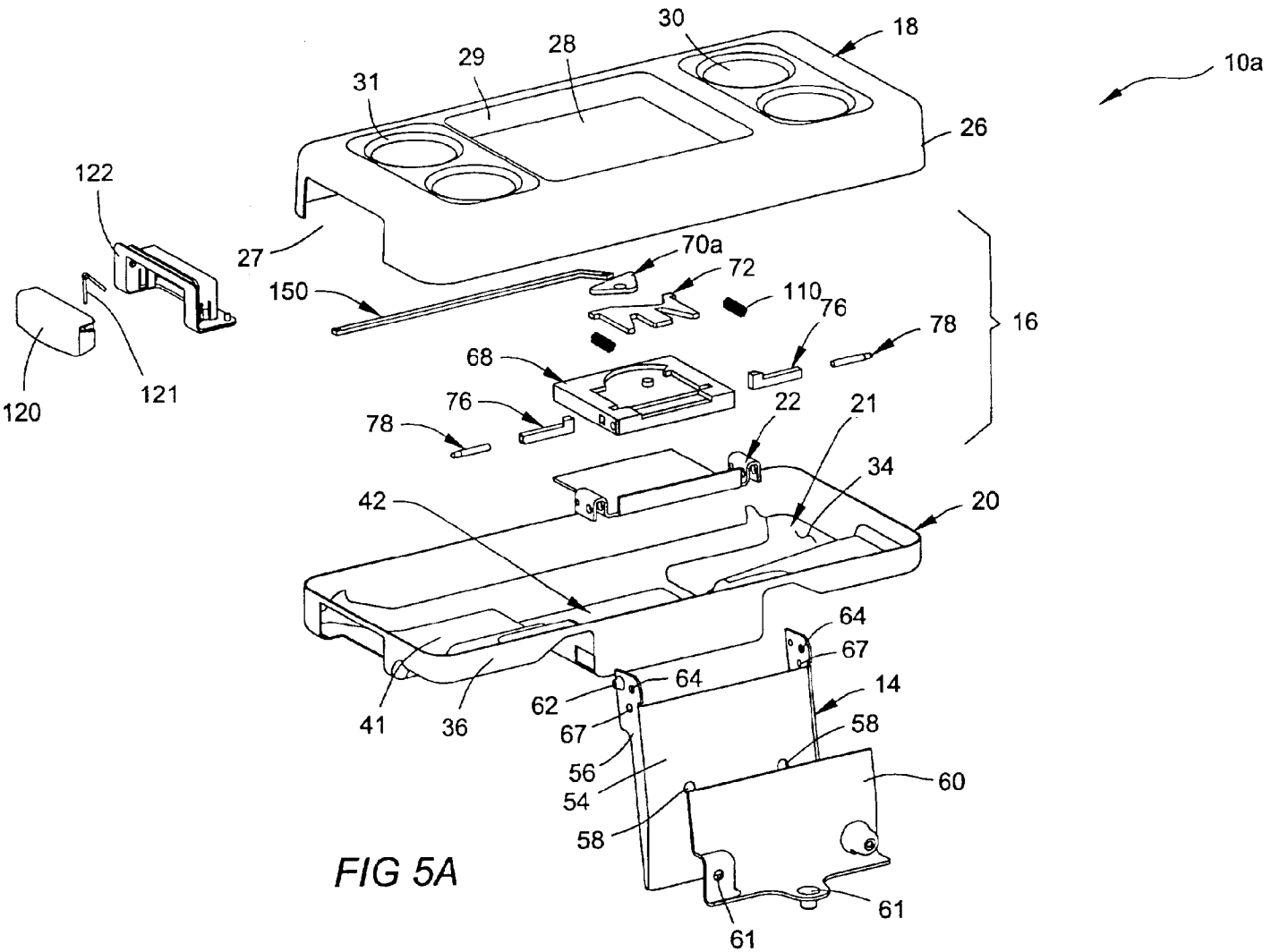
FIG. 5A is an exploded view of a second embodiment of a tray assembly in accordance with the principals of the present invention.
Figure 5B:
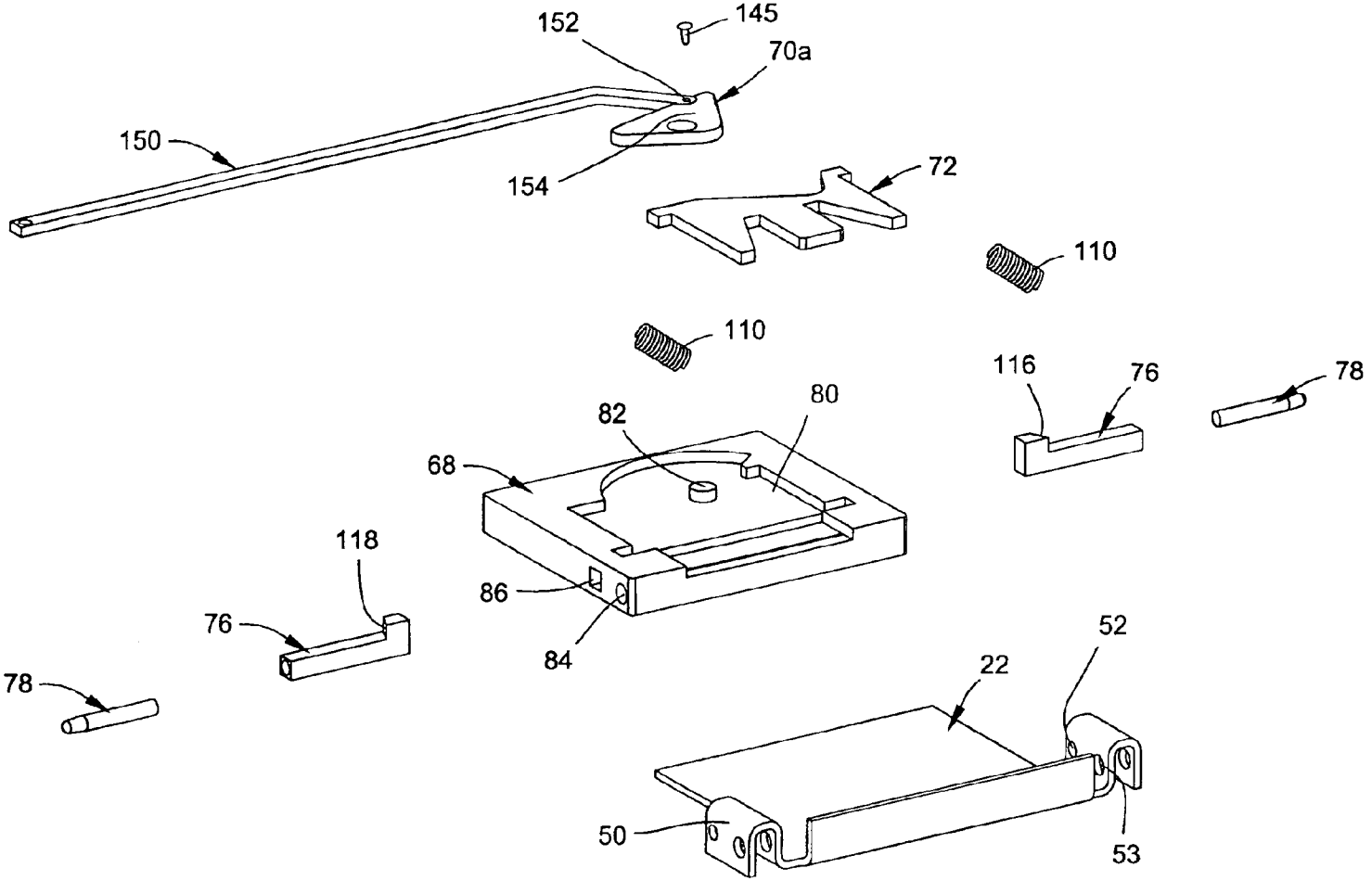
FIG. 5B is a more detailed exploded view of particular components of FIG. 5A.
Figure 6:
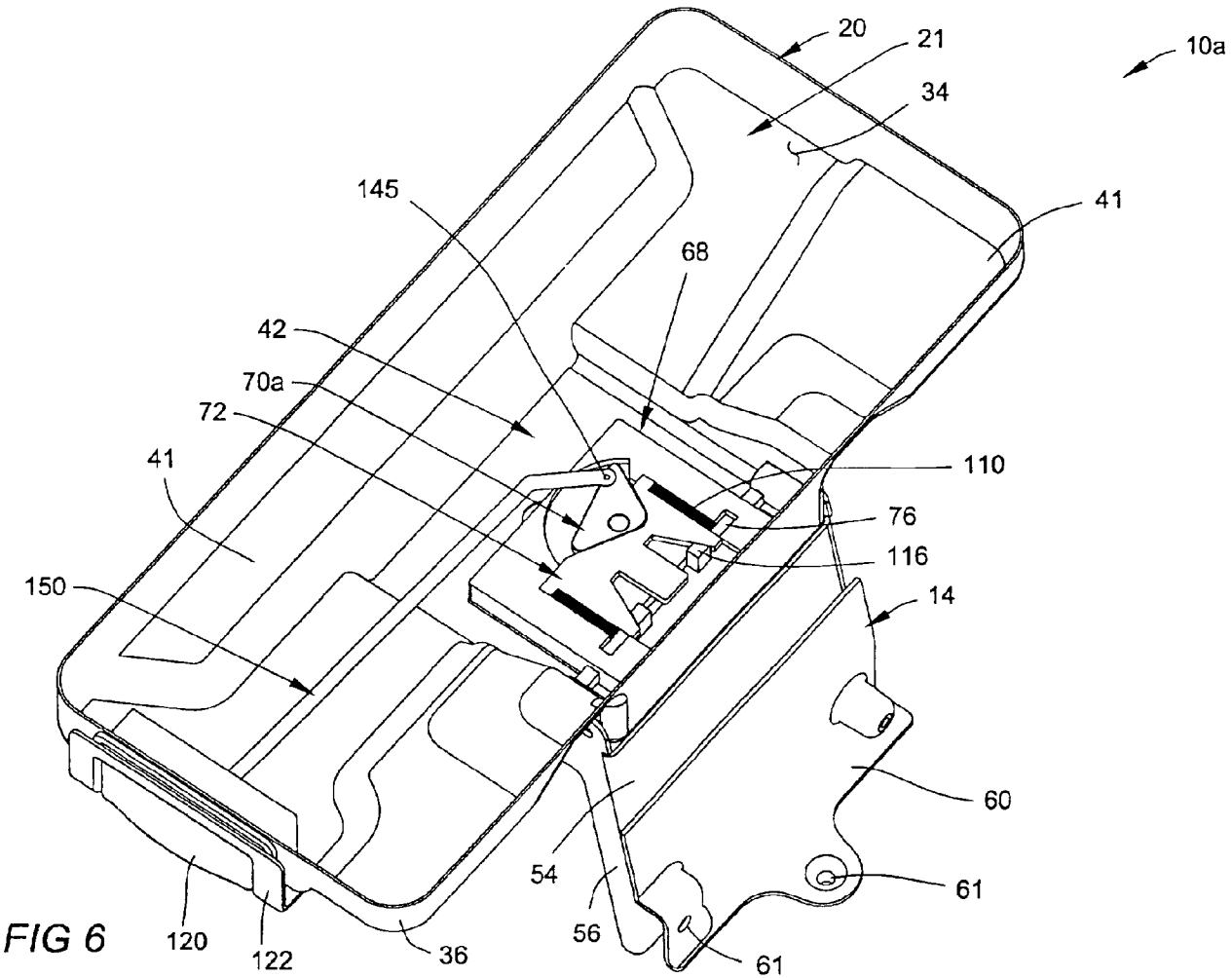
FIG. 6 is a perspective view of the tray assembly of FIG. 5A with part of a housing removed to show a locking mechanism of the tray assembly in an engaged position.

The base 20 includes a bottom surface 34, a second flange 36 and a handle cutout 40. The bottom surface 34 extends generally across the base 20 and includes a series of strengthening ribs 41 and a locking recess 42, as best shown in FIG. 2A. The locking recess 42 extends generally away from the bottom surface 34 and receives the locking mechanism 16, as best shown in FIGS. 3 and 4. The locking recess 42 further includes a pair of slots 44 for interaction with the locking mechanism 16, whereby the slots 44 provide clearance for the locking mechanism 16 to interact with the support member 14, as will be discussed further below. The second flange 36 axially surrounds the bottom surface 34 and includes the handle cutout 40 as best shown in FIG. 2A.

Figure 2B:
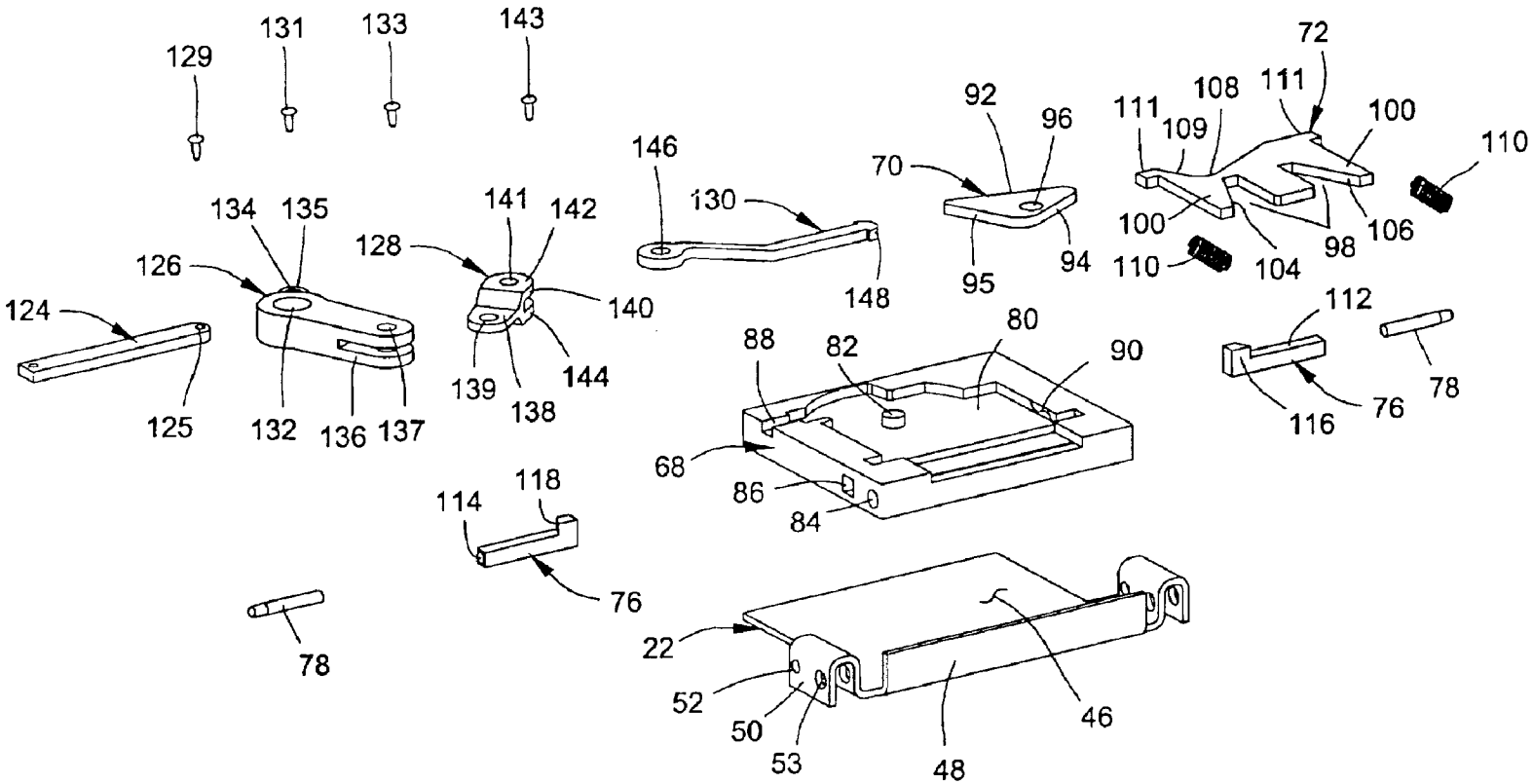
FIG. 2B is a more detailed exploded view of particular components of FIG. 2A.

The reinforcement bracket 22 is disposed within the locking recess 42 and includes a planer surface 46, a back surface 48 formed generally perpendicular to the planer surface 46, and a pair of side supports 50 each having a first and second aperture 52, 53 formed therethrough. The side supports 50 include a generally U-shape, whereby the first and second apertures 52, 53 extend through the U-shape, as best shown in FIGS. 2A and 2B. The reinforcement bracket 22 serves to strengthen the base 20 locally around the locking mechanism 16, whereby the reinforcement bracket 22 is disposed generally between the locking mechanism 16 and the base 20. While the reinforcement bracket 22 is disclosed as a separate member, it should be understood that the reinforcement bracket 22 could be formed integral with the base 20 and as such is anticipated by the present invention.

The cover 18 is fixedly attached to the base 20 through the interaction of the first flange 26 with second flange 36. Specifically, the first flange 26 axially surrounds the second flange 36 to fixedly attach the cover 18 to the base 20, as best shown in FIG. 1. In this manner, the cover 18 overlaps the base 20 due to the relationship of the first flange 26 to the second flange 36. The cover 18 can be fixedly attached to the base 20 through the frictional engagement between an inner surface of the first flange 26 and an outer surface of the second flange 36 and may be supplemented by a suitable means such as epoxy or glue. In one embodiment, the cover 18 is formed from a plastic material and the base 20 is formed from a metal material such as steel, whereby the foregoing attachment methods adequately secure the cover 18 to the base 20. In the event the cover 18 is formed from steel and the base is similarly formed from steel, the cover 18 may also be welded to the base 20 in addition to the methods discussed above. In either construction described above, the base 20 and the cover 18 may be fixedly attached through the use of mechanical fasteners.

In fixedly attaching the cover 18 to the base 20, an interior space 21 is created therebetween. The interior space 21 is provided such that the locking mechanism 16 and actuation mechanism components, such as actuation handles and link components, are allowed to freely operate between the cover 18 and the base 20. It can be appreciated that the general shape and depth of the interior space 21 is governed by the length of the first and second flanges 26, 36. Specifically, because the second flange 36 contacts a bottom surface of the cover 18 when assembled, the length of the second flange 36 generally defines the distance between the bottom surface 34 of the base 20 and the top surface 24 of the cover 18. For example, the farther the second flange 36 extends from the bottom surface 34, the greater the interior space 21 formed between the cover 18 and the base 20.

The interior space 21 allows the working components of the tray assembly 10 to be enclosed within the tray member 12 such that exterior moving links or supports are not exposed outside of the tray member 12. Specifically, the locking mechanism 16 is disposed within the interior space 21, and is operable to selectively engage the support member 14 through clearances provided in the base 20, as will be described in more detail below. In this manner, lock mechanism 16 and actuation mechanism components for selectively locking the tray member 12 with respect to the support member 14 are not exposed. In addition, exterior support brackets extending between the support member 14 and the tray member 12 are not required as the tray member 12 is supported by the rigid base 20 in cooperation with the support member 14.

Figure 19:
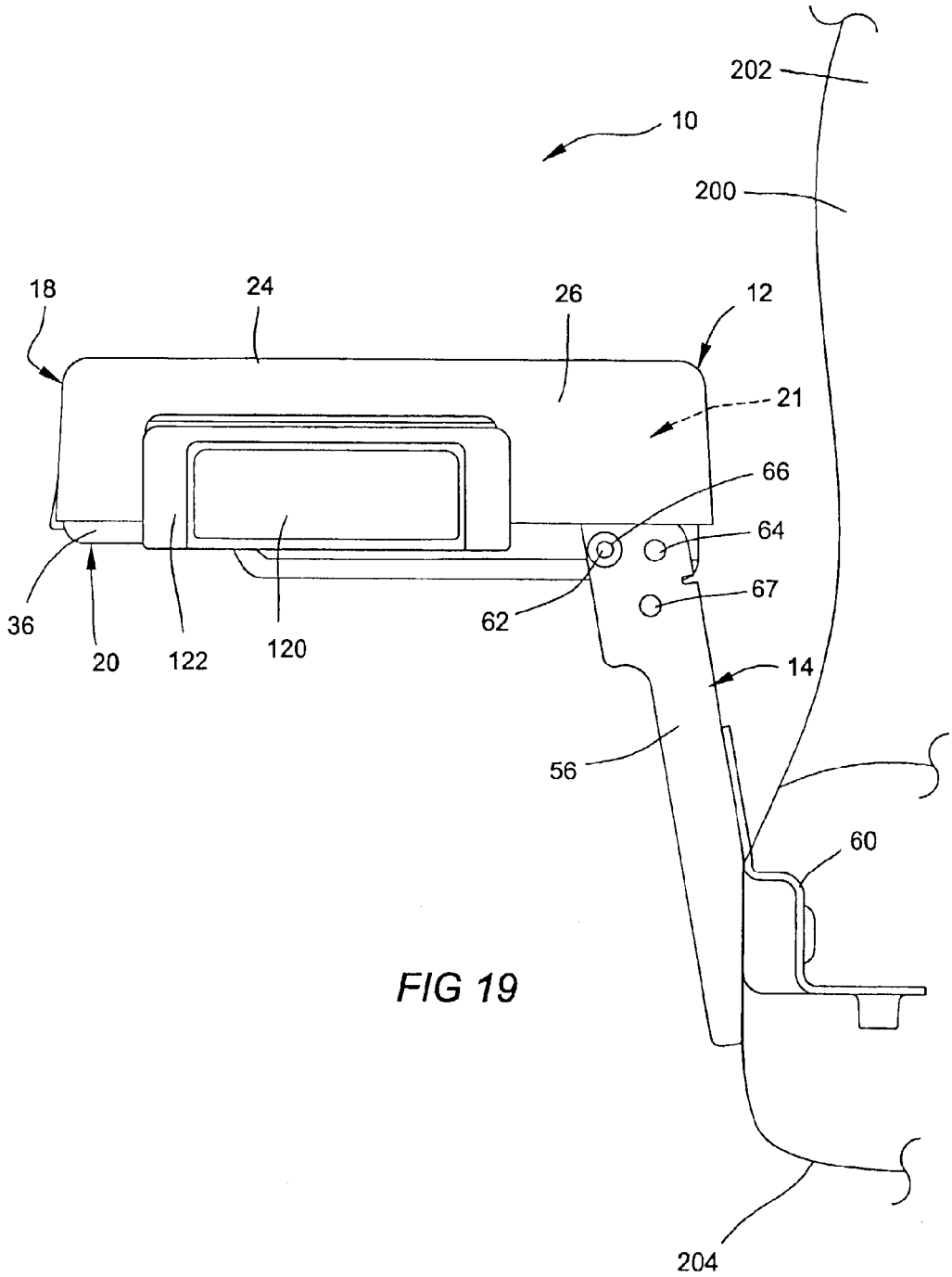
FIG. 19 is a side view of the tray assembly of FIG. 1 attached to a seat in a use position.

By enclosing the locking mechanism 16 and actuation mechanism components within the interior space 21, and further by providing support for the tray member 12 through the interaction of the rigid base 20 and the support member 14, no external supports or linkages are visible when the tray member 12 in the use position. Generally speaking, the interior space 21, in combination with the rigid base 20, allow the tray member 12 and support member 14 to have a generally L-shape in the use position, thereby providing an open area directly under the tray member 12, as best shown in FIG. 19. In this manner, the overall aesthetics of the tray assembly 10 are improved through the cooperation between tray member 12 and support member 14.

The support member 14 includes a generally planer body 54 and a pair of side supports 56. The planer body 54 includes a pair of attachment apertures 58, whereby the attachment apertures 58 receive a pair of fasteners 59 to either directly attach the support member 14 to a structure or alternatively attach the support member 14 to a second mounting bracket 60, as best shown in FIG. 2A. The second mounting bracket 60 adapts to the particular application of the folding tray assembly 10 such that a common support member 14 may be used for a plurality of applications. Specifically, the second mounting bracket 60 adapts to the varying structures that the folding tray assembly 10 may be attached to by providing a plurality of different mounting apertures in varying locations. To this end, the second mounting bracket 60 generally includes a plurality of attachment apertures 61 disposed in different areas of the second mounting bracket 60. In this manner, the support member 14 can remain common over a range of applications requiring only the second mounting bracket 60 to be modified, thereby reducing tooling and engineering expenditures.

The side supports 56 extend from the planer body 54 and include a first and second attachment aperture 62, 64. The first attachment aperture 52 includes a collar 66 for interaction with the locking mechanism 16, as will be described in more detail below. The second attachment aperture 64 receives a pin 65 for attachment to the locking mechanism 16 such that the tray 12 is permitted to rotate relative the support member 14 about he pin.

The locking mechanism 16 includes a housing 68, a cam 70, a cam plate 72, a pin housing 76, and a pair of pins 78. The housing 68 includes a central recess 80, a post 82, an attachment bore 84, and a pin bore 86. The post 82 is disposed in the central recess 80, whereby the central recess 80 further includes a slot 88 for interaction with a link assembly 74. The formation of the central recess 80 with the housing 68 further forms a reaction surface 90 axially surrounding the central recess 80. The cam 70 includes a first, second, and third reaction surface 92, 94, 95 and an attachment aperture 96. The attachment aperture 96 rotatably receives the post 82, whereby the cam is free to rotate about the post 82 within the central recess 80.

The cam plate 72 includes a pair of slots 98 disposed between a pair of fingers 100 and further includes a generally V-shaped notch 102 disposed opposite the fingers 100. The fingers 100 include a ramped section 104 having an engagement surface 106. The V-shaped notch 102 includes a reaction surface 109 for interaction with the cam 70, as will be discussed further below. The cam plate 72 further includes a pair of flanges 111 which flank the V-shaped notch 102 for interaction with a pair of springs 110. Specifically, the springs 110 are fixedly attached to the flanges 108 at a first end and are fixedly attached to the housing 68 at a second end, as best shown in FIGS. 3 and 4. Specifically, the springs 110 engage the reaction surface 90 of the housing 68 to bias the cam plate 72 in a first direction.

The pin housings 76 fixedly receive the pins 78 such that the pins 78 move concurrently therewith. The pin housings 76 are slidably received by the housing 68 through the pin bores 86. The pin housings 76 include an elongate generally rectangular body 112 having a bore 114 formed therein for fixedly receiving a pin 78 and further include a post 116 having a reaction surface 118 formed thereon. The elongate body 112 is received by the bore 86, whereby the post 116 extends upwardly from the pin housing 68, as best shown in FIGS. 3 and 4. Movement of the pin housings 76 within the bores 86 is restricted to a linear translation through the bores 86 due to the relationship between the generally rectangular cross-section of the bores 86 to the generally rectangular cross-section of the pin housings 76. In this manner, the interaction between the generally rectangular cross-section of the pin housings 76 to the generally rectangular cross-section of the bores 86 adequately restricts the pin housings 76 to a generally linear movement.

The pins 78 move linearly with the pin housings 76 between an engaged position and a disengaged position. In the engaged position, the pins 78 extend outside of the housing 68 and through the attachment apertures 52 of the side supports 50. When the tray 12 is in an upright or use position, as shown in FIG. 19, the pins 78 extend through aperture 62 of the side supports 56 and through the apertures 66 of the support member 14, whereby collars 66 help to support the weight and force exerted by the pins 78 on the side supports 56. When the tray is in the stowed position, the pins 78 are received by a pair of bores 67 disposed on the side supports 56 of the support member 14. As shown FIG. 20, Bores 67 receive the pins 78 to lock the tray 12 in the stowed position. In another embodiment, the bores 67 are replaced with a pair of detents (not shown), whereby the pins 78 engage the dents to hold the tray 12 in the stowed position. In the disengaged position, the pins 78 are caused to move out of engagement with the support member 14 such that the support member 14 is free to rotate relative to the tray 12. Specifically, the pins 78 disengage the apertures 62 and are effectively pulled within the body of the tray 12 thus permitting the tray 12 to rotate relative to the support member 14.

The posts 116 of the pin housings 76 generally control the movement of the pins 78 through the interaction of the posts 116 and the cam plate 72. Specifically, the posts 116 extend generally away from a surface of the central recess 80, such that the reaction surface 118 of the posts 116 are in slidable contact with the engagement surfaces 106 of the cam plate 72. The posts 116 are free to slide along the ramped portion 104 of the fingers 100 about the engagement surfaces 106. Due to the bias of the springs 110, the cam plate 72 is biased into the first direction such that the posts 116 are near the bottom of the fingers 100 and the pin housings 76 are fully extended and the pins 78 are in the engaged position. When a force is applied to the cam plate 72 against the bias of the springs 110, the cam plate 72 is caused to move in a second direction. When the cam plate 72 moves in the second direction, the posts 116 are caused to travel along the fingers 100 generally towards to the V-shaped notch 102 due to the relative movement of the cam plate 72. In traveling up the ramped section 104 of the fingers 100, the posts 116 cause the pin housings 76 to travel inward such that the pins 78 are retracted into the disengaged position. Again, when the pins 78 are in the retracted position, the tray 12 is free to rotate freely relative to the support member 14.

To apply a force to the cam plate 72, an actuation handle 120 is provided and includes a frame 122 for support the handle 120 in the tray 12. Specifically, the frame 122 is disposed within the handle cutout 40 of the tray 12 and pivotably receives the handle 120. The frame 122 serves to secure the handle 120 to the tray 12 and further provides a surface for which a return spring 121 may be attached. The return spring 121 biases the handle 120 into a position such that the handle 120 is generally flush with an outer surface of the first flange 26. For example, when a force is applied to the handle 120 against the bias of the handle spring 121, the handle 120 will be caused to extend away from the body of the tray 12. To return the handle 120, the handle spring 121 reacts against the frame 122 and pulls the handle 120 back into alignment with the outer surface of the first flange 26. Alternatively, if the handle 120 is actuated by push means such that the handle 120 rotates inwards towards the body of the tray 12, the return spring 121 serves to push the handle 120 out and back into a flush relationship with the outer surface of the first flange 26.

In the first embodiment as shown in FIGS. 2A–4, the actuation handle 120 is connected to the cam 70 through the link assembly 74. The link assembly 74 includes a first link 124, a cam 126, a connector 128, and a second link 130. The first link 124 is connected to the handle 120 at a first end and at a second end pivotably connected to a cam 126. Specifically, the first link 124 includes an attachment aperture 125 which receives a pin 129 for rotatable attachment to the cam 126. The cam 126 is rotatably supported by the base 20 and serves to transmit the force exerted by the link 124. Specifically, the cam 126 includes a central aperture 132 and a first and second arm 134, 136. The first arm 134 includes a first aperture 135 while the second arm 136 includes a second aperture 137. The central aperture 132 receives a pin 131 for rotatable attachment to the base 20 while the first aperture 135 receives pin 129 for rotatable attachment to the first link 124 and second aperture 137 receives pin 133 for rotatable attachment to the connector 128 respectively.

The connector 128 includes a first arm 138 having an aperture 139 formed therethrough for rotatable attachment to the second arm 136 of the cam 126 as previously discussed. The connector 128 further includes a second arm 140 having an upper and lower section 142, 144 including a second aperture 141, whereby the second aperture 141 extends through both the upper and lower sections 142, 144 of the second arm 140. The second link 130 is a generally flat member having an aperture 146 at a first end and an engagement face 148 at a second end. The first end of the second link 130 is inserted into a space between the upper and lower sections 142, 144 of the connecter 128 such that aperture 146 is aligned with aperture 141. To rotatably attach the second link 130 to the connector 128, a pin 143 is inserted through aperture 141 and aperture 146. The second end of the second link 130 is in operable communication with the cam plate 70, such that the engagement face 148 is in contact with the first reaction surface 92 of the cam plate 70.

With reference to FIGS. 3 and 4, the operation of the folding tray assembly 10 will be described in detail. FIG. 3 depicts the folding tray 10 in the engaged position, whereby the pins 78 are seeded in the apertures 62 of the support member 14. To disengage the pins 78 from the apertures 62, a force is applied to the handle 120 such that the first link 124 rotates the cam 126. Rotation of the cam 126 causes rotation of the connector 128 and ultimately translation of the second link 130. Once the handle 120 is sufficiently rotated, translation of the second link 130 will cause the cam 70 to rotate.

As the cam 70 rotates, the second reaction surface 94 rotates about the reaction surface 109 of the V-shaped notch 102. As the reaction surface 94 of the cam 70 moves along the V-shaped notch 108, the cam plate 72 is caused to move in the second direction against the bias of the springs 110. Sufficient movement of the cam plate 72 in the second direction causes the posts 116 of the pin housings 76 to move up the ramped sections 104 of the fingers 100. Sufficient movement of the posts 116 up the fingers 100 causes the pins 78 to disengage the apertures 62 of the support member 14. Once the pins 78 have disengaged the apertures 62, the tray 12 is free to rotate about the support member 14.

Once the pins 78 have been removed from the apertures 62, and the tray 12 has begun to be rotated towards the stowed position, the bias of the springs 110 will cause the cam plate 72 to move in the first direction thus causing the pin housings 76 to slide down the fingers 100 such that the pins 78 are now biased against an inner surface of the side supports 50 of the support member 14 as shown in FIG. 4. As the tray 12 is rotated sufficiently such that it is in the stowed position, the pins 78 will automatically engage the apertures 67 to lock the tray 12 in the stowed position due to the bias imparted by the springs 110 through the cam plate 72 and the pin housings 76. It should be understood that once the pins 78 have been disengaged from the apertures 62 and are traveling on the inner surface of the side supports 50, the actuation handle 120 may be released, whereby the handle spring 121 will bias the handle 120 back into a flush relationship with the outer surface of the first flange 26.

In a second embodiment as shown in FIGS. 5A–7, the actuation handle 120 is connected to the cam 70*a* through a link 150. In view of the substantial similarity in structure and function of the components associated with the folding tray assembly 10 with respect to the folding tray assembly 10*a*, like reference numerals are used hereinafter and in the drawings to identify like components while like reference numerals containing letter extensions are used to identify those components that have been modified. The link 150 is attached to the handle 120 at a first end and to the cam 70*a* at a second end. Specifically, the second end of the link 150 includes an aperture 152 for attachment to the cam 70*a*. Cam 70*a* includes an aperture 154, whereby the aperture 154 receives a pin 145 for rotatable attachment to the link 150 through aperture 152. Again, the cam 70*a* and link 150 are disposed within the interior space 21, thereby having all moving parts disposed between the over 18 and the base 20.

With reference to FIGS. 5A–7, the operation of the folding tray assembly 10*a* will be described in detail. To release the tray 12 from the use position as shown in FIG. 19, a force is applied to the handle 120 such that the link 150 is caused to translate. Translation of the link 150 causes the cam 70*a* to rotate due to the pivotal connection between the link 150 and the cam plate 70*a*. Rotation of the cam 70*a* causes the third reaction surface 95 to engage the V-shaped notch 108 and cause the cam plate 72 to move in the second direction against the bias of the springs 110.

As the third reaction surface 95 of the cam 70*a* moves along the V-shaped notch 108, the cam plate 72 is caused to move in the second direction against the bias of the springs 110. Sufficient movement of the cam plate 72 in the second direction causes the posts 116 of the pin housings 76 to move up the ramped sections 104 of the fingers 100. Sufficient movement of the posts 116 up the fingers 100 causes the pins 78 to disengage the apertures 62 of the support member 14. Once the pins 78 have disengaged the apertures 62, the tray 12 is free to rotate about the support member 14.

Figure 7:
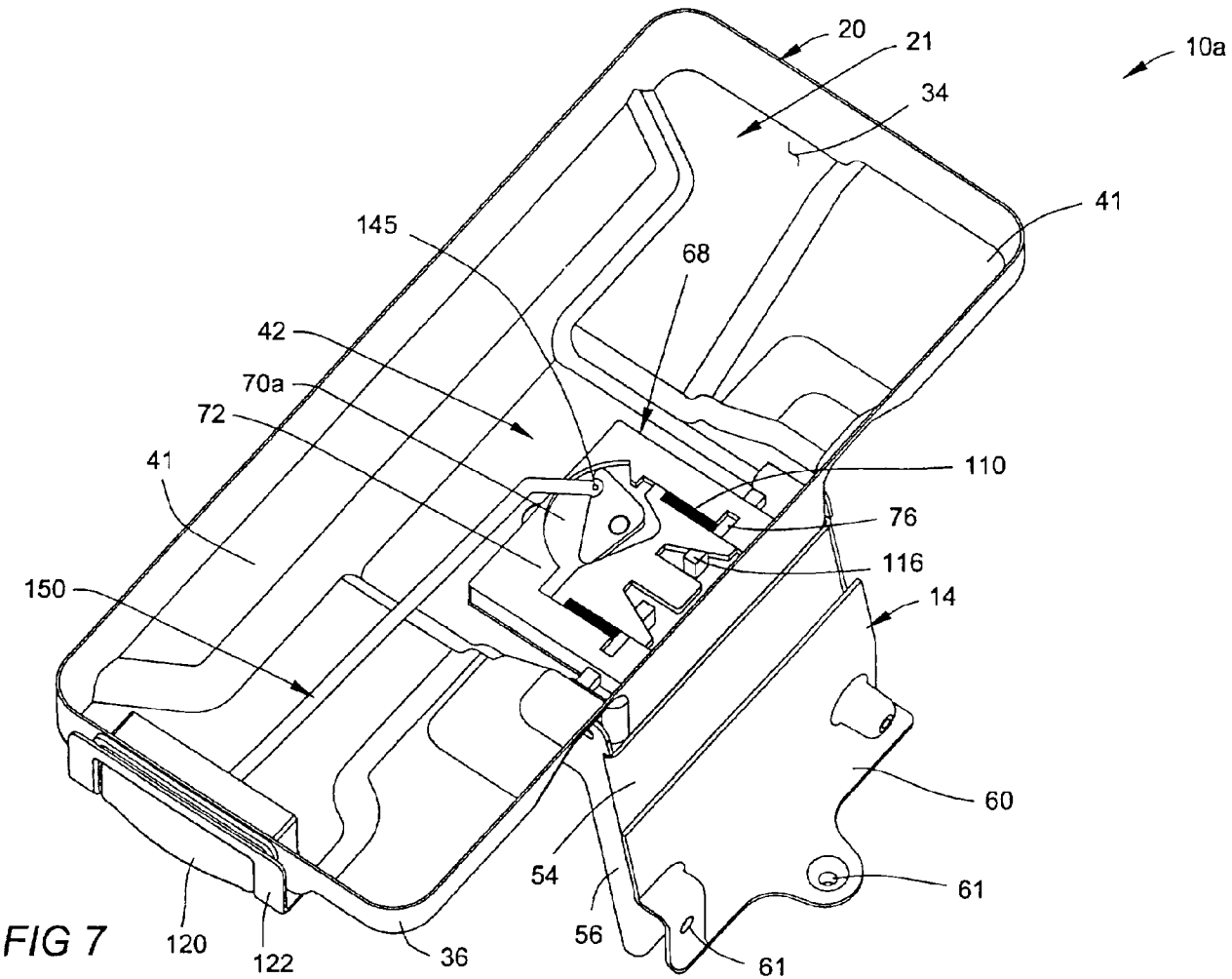
FIG. 7 is a perspective view of the tray assembly of FIG. 5A with part of a housing removed to show a locking mechanism of the tray assembly in a disengaged position.
Figure 8A:
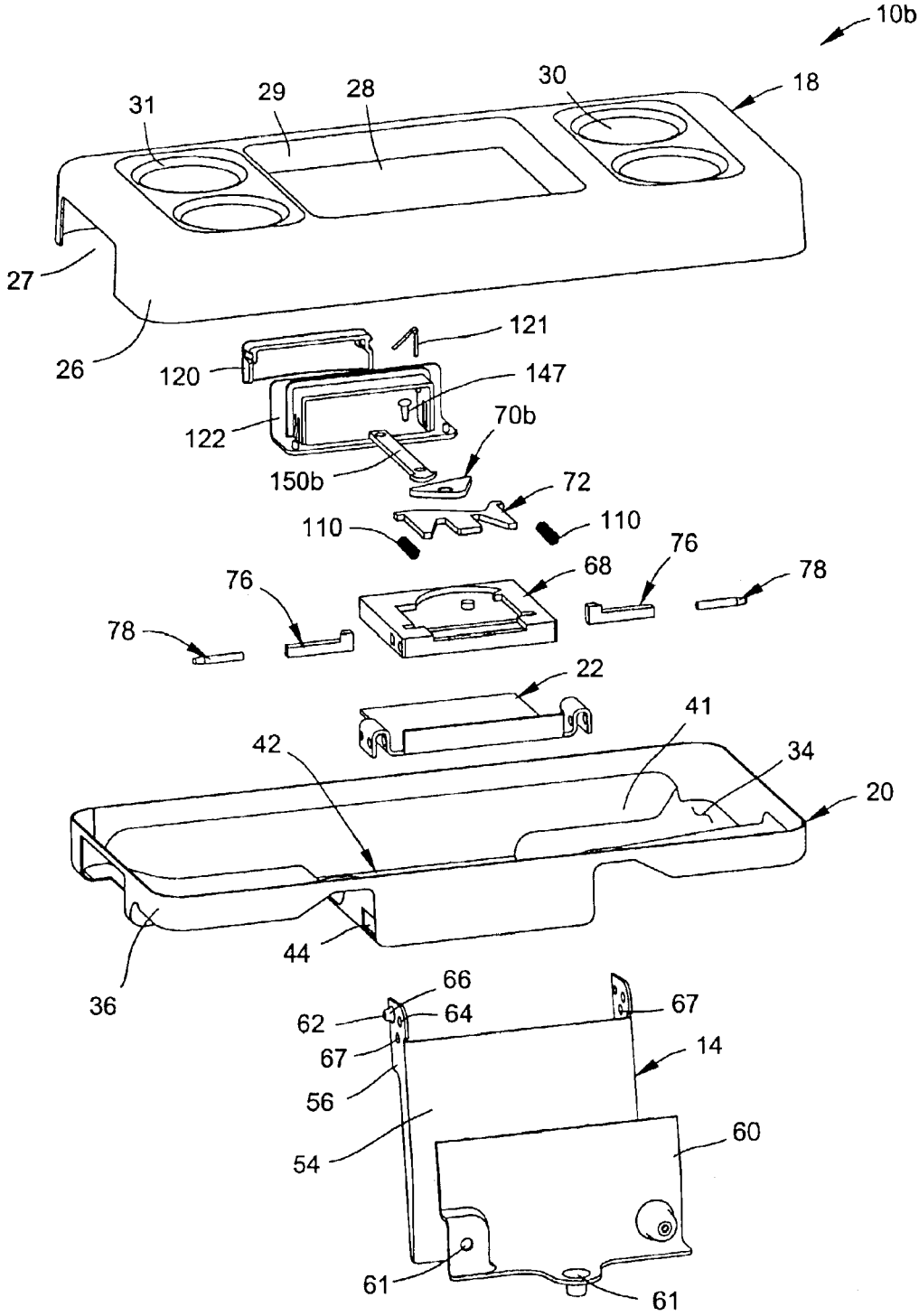
FIG. 8A is an exploded view of a third embodiment of a tray assembly in accordance with the principals of the present invention.
Figure 8B:
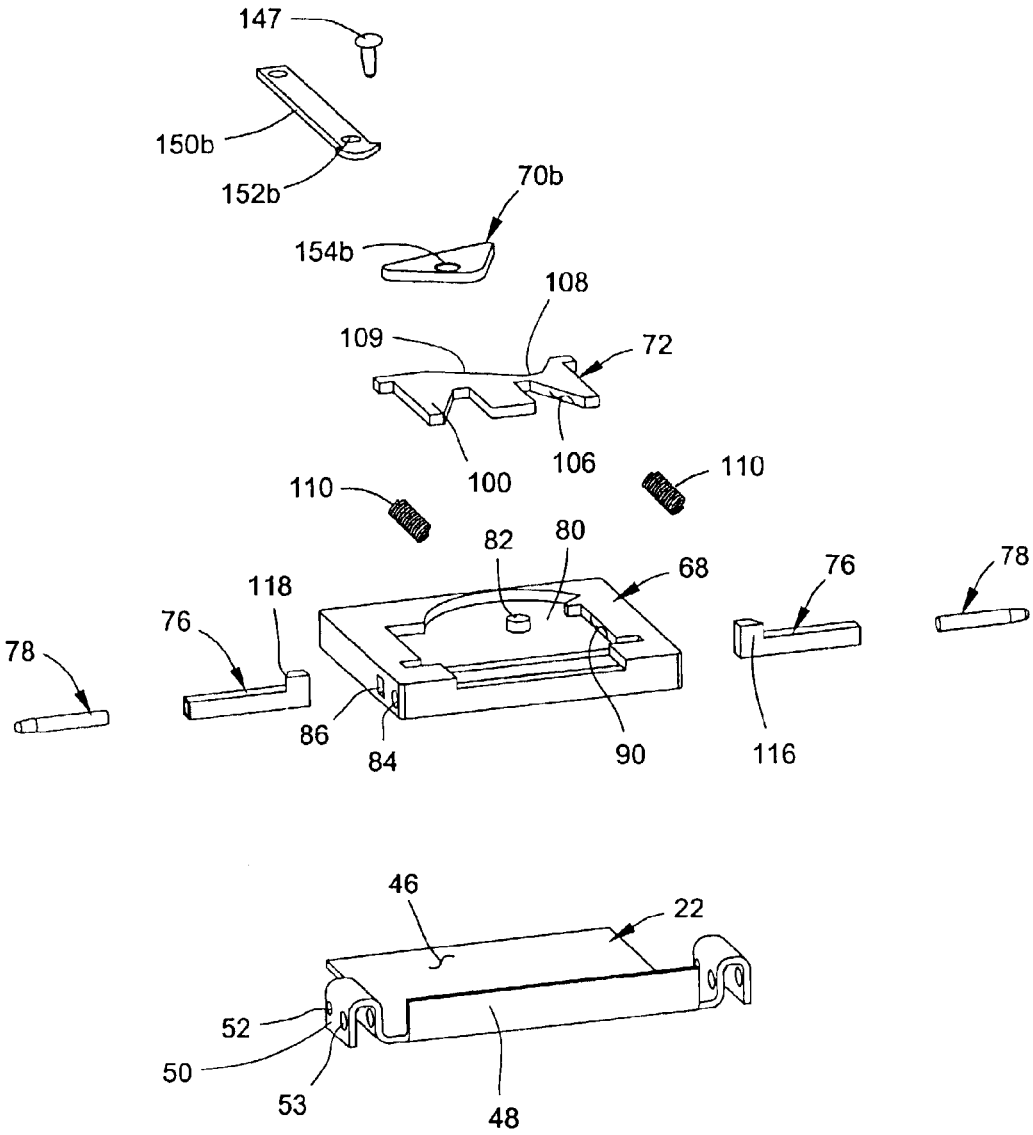
FIG. 8B is a more detailed exploded view of particular components of FIG. 8A.

Once the pins 78 have been removed from the apertures 62, and the tray 12 has begun to be rotated towards the stowed position, the bias of the springs 110 will cause the cam plate 72 to move in the first direction thus causing the pin housings 76 to slide down the fingers 100 such that the pins 78 are now biased against an inner surface of the side supports 50 of the support member 14 as shown in FIG. 7. As the tray 12 is rotated sufficiently such that it is in the stowed position, the pins 78 will automatically engage the apertures 67 to lock the tray 12 in the stowed position due to the bias imparted by the springs 110 through the cam plate 72 and the pin housings 76. It should be understood that once the pins 78 have been disengaged from the apertures 62 and are traveling on the inner surface of the side supports 50, the actuation handle 120 may be released, whereby the handle spring 121 will bias the handle 120 back into a flush relationship with the outer surface of the first flange 26.

In a third embodiment as shown in FIGS. 8A–10, the actuation handle 120 is connected to the cam 70*b* through a link 150*b*. In view of the substantial similarity in structure and function of the components associated with the folding tray assembly 10 with respect to the folding tray assembly 10*b*, like reference numerals are used hereinafter and in the drawings to identify like components while like reference numerals containing letter extensions are used to identify those components that have been modified.

Figure 9:
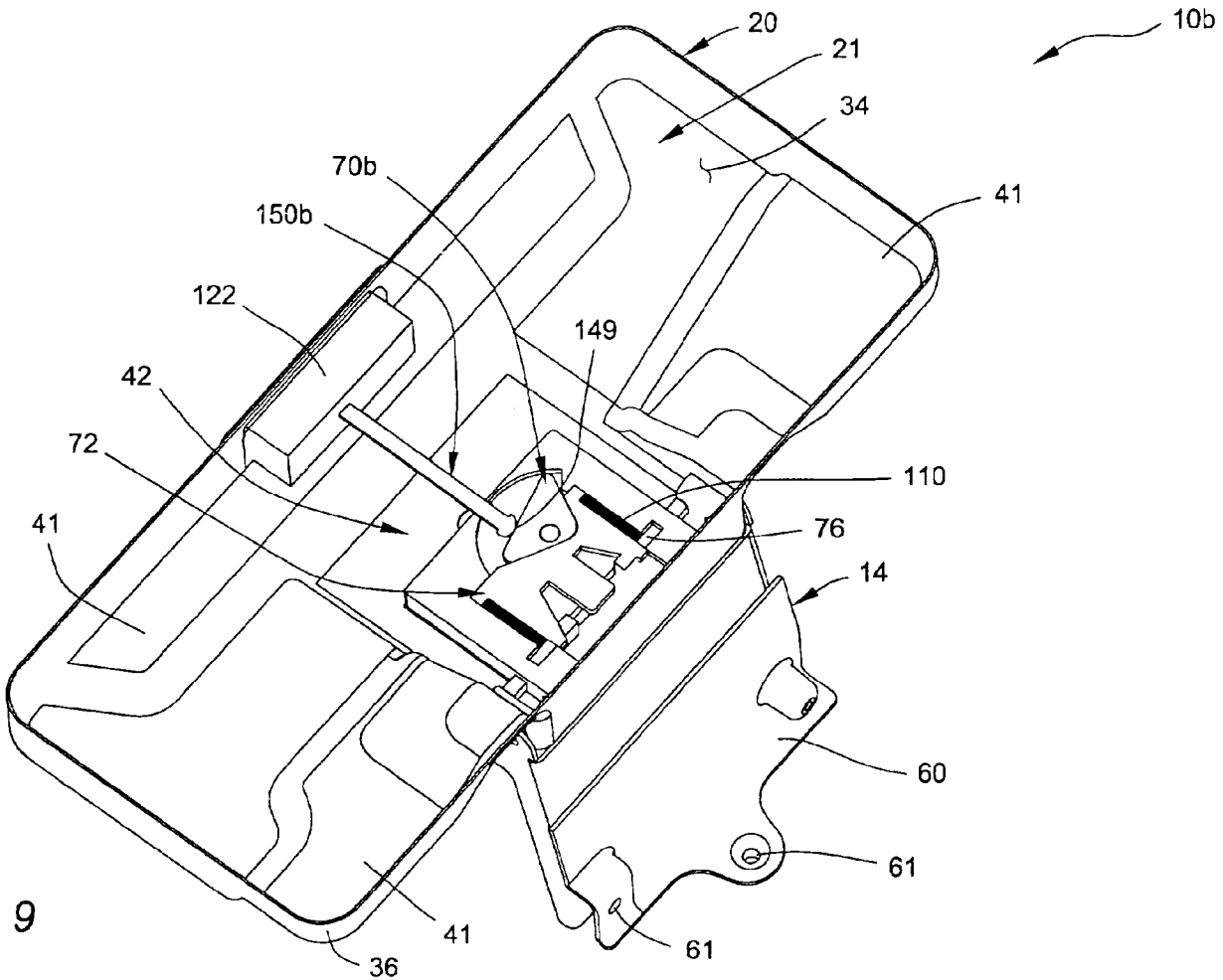
FIG. 9 is a perspective view of the tray assembly of FIG. 8A with part of a housing removed to show a locking mechanism of the tray assembly in an engaged position.
Figure 10:
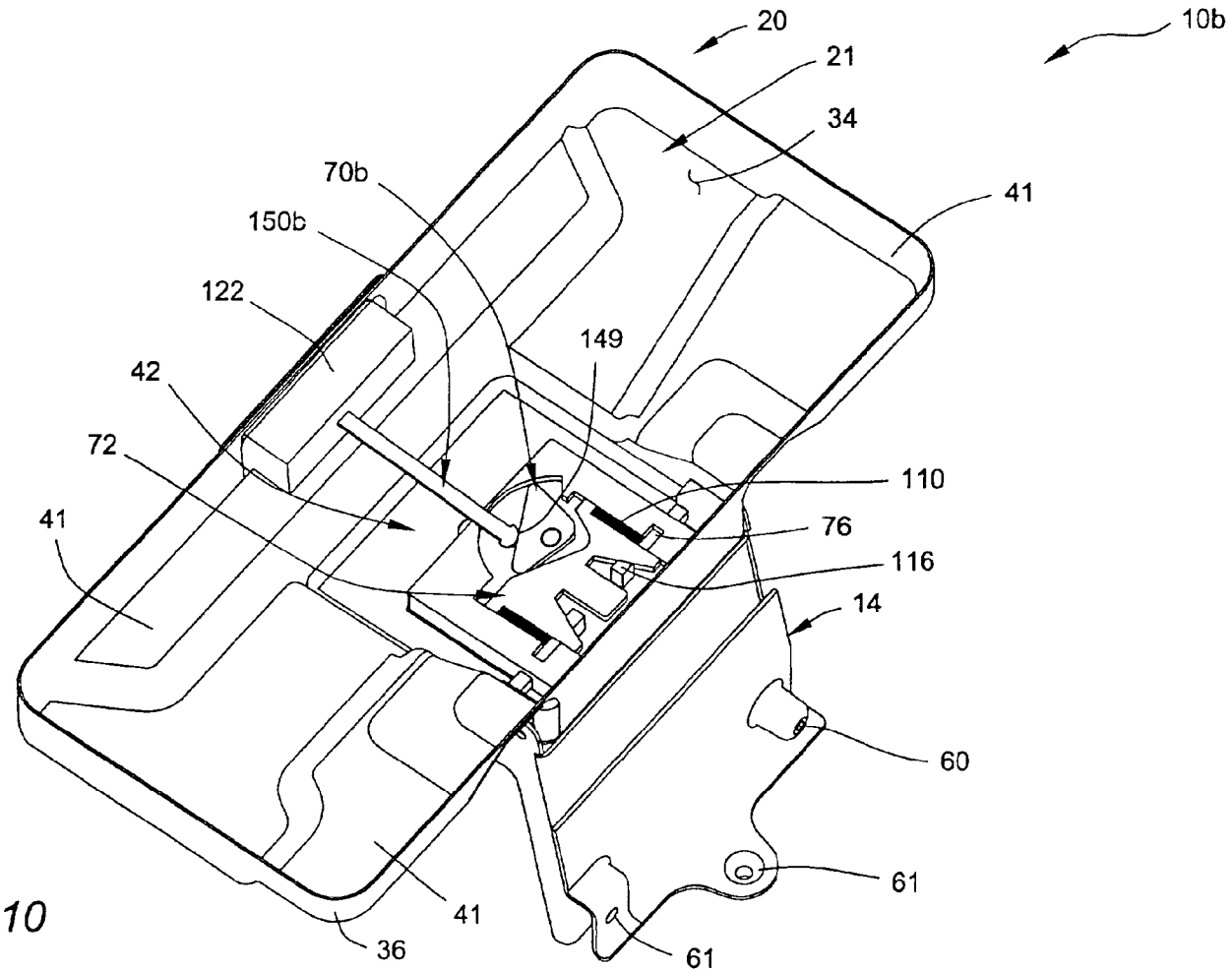
FIG. 10 is a perspective view of the tray assembly of FIG. 8A with part of a housing removed to show a locking mechanism of the tray assembly in a disengaged position.

The link 150*b* is attached to the handle 120 at a first end and to the cam 70*b* at a second end. Specifically, the second end of the link 150*b* includes an aperture 152*b* for attachment to the cam 70*b*. Cam 70*b* includes an aperture 154*b*, whereby the aperture 154*b* receives a pin 147 for rotatable attachment to the link 150*b* through aperture 152*b*. Alternatively, the link 150*b* includes an engagement surface 149 at a distal end which is in contact with the first reaction surface 92 of the cam 70*b* rather than attached thereto by a pin, as shown in FIGS. 9–10. In either construction, the link 150*b* imparts a force on cam 70*b* such that rotation of the cam 70*b* will cause the third reaction surface 95 to engage the V-shaped notch 108. Additionally, the link 150*b* and cam 70*b* are disposed within the interior space 21 of the tray member 12 and thus are housed entirely between the cover 18 and base 20.

With reference to FIGS. 8A–10, the operation of the folding tray assembly 10*b* will be described in detail. To release the tray 12 from the use position as shown in FIG. 19, a force is applied to the handle 120 such that the link 150*b* is caused to translate. Translation of the link 150*b* causes the cam 70*b* to rotate due to the pivotal connection between the link 150*b* and the cam plate 70*b*. Rotation of the cam 70*b* causes the third reaction surface 95 to engage the V-shaped notch 108 and cause the cam plate 72 to move in the second direction against the bias of the springs 110.

As the third reaction surface 95 of the cam 70*b* moves along the V-shaped notch 108, the cam plate 72 is caused to move in the second direction against the bias of the springs 110. Sufficient movement of the cam plate 72 in the second direction causes the posts 116 of the pin housings 76 to move up the ramped sections 104 of the fingers 100. Sufficient movement of the posts 116 up the fingers 100 causes the pins 78 to disengage the apertures 62 of the support member 14. Once the pins 78 have disengaged the apertures 62, the tray 12 is free to rotate about the support member 14.

Once the pins 78 have been removed from the apertures 62, and the tray 12 has begun to be rotated towards the stowed position, the bias of the springs 110 will cause the cam plate 72 to move in the first direction thus causing the pin housings 76 to slide down the fingers 100 such that the pins 78 are now biased against an inner surface of the side supports 50 of the support member 14 as shown in FIG. 10. As the tray 12 is rotated sufficiently such that it is in the stowed position, the pins 78 will automatically engage the apertures 67 to lock the tray 12 in the stowed position due to the bias imparted by the springs 110 through the cam plate 72 and the pin housings 76. It should be understood that once the pins 78 have been disengaged from the apertures 62 and are traveling on the inner surface of the side supports 50, the actuation handle 120 may be released, whereby the handle spring 121 will bias the handle 120 back into a flush relationship with the outer surface of the first flange 26.

It should be understood that both locking mechanisms 16*a* and 16*b* are disposed within the interior space 21 of the tray member 12, generally between the cover 18 and the base 20. In this manner, locking mechanisms 16*a* and 16*b* function between the cover 18 and base 20, such that no moving parts are disposed outside of the tray member 12. In this regard, having locking mechanisms 16*a* and 16*b* disposed within the interior space 21 allows the tray assembly 10 to have a generally L-shape in the use position.

In a fourth embodiment as shown in FIGS. 11–14, the tray assembly 10*c* includes the locking mechanism 16*c* having a first and second tube 158, 160 in communication with the tray 12 and the support member 14*c*. In view of the substantial similarity in structure and function of the components associated with the folding tray assembly 10 with respect to the folding tray assembly 10*c*, like reference numerals are used hereinafter and in the drawings to identify like components while like reference numerals containing letter extensions are used to identify those components that have been modified.

Figure 11:
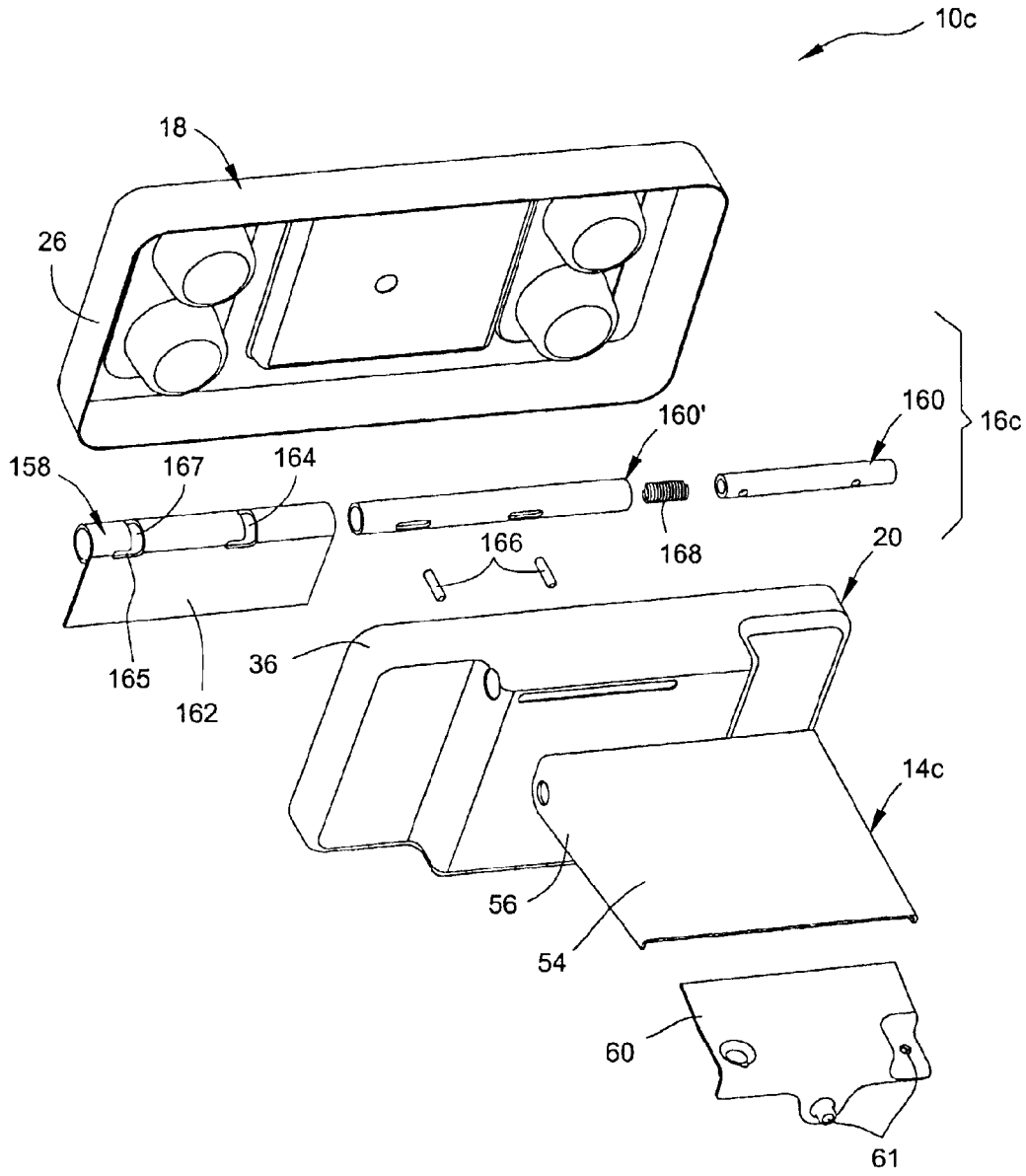
FIG. 11 is an exploded view of a fourth embodiment of a tray assembly in accordance with the principals of the present invention.
Figure 12:
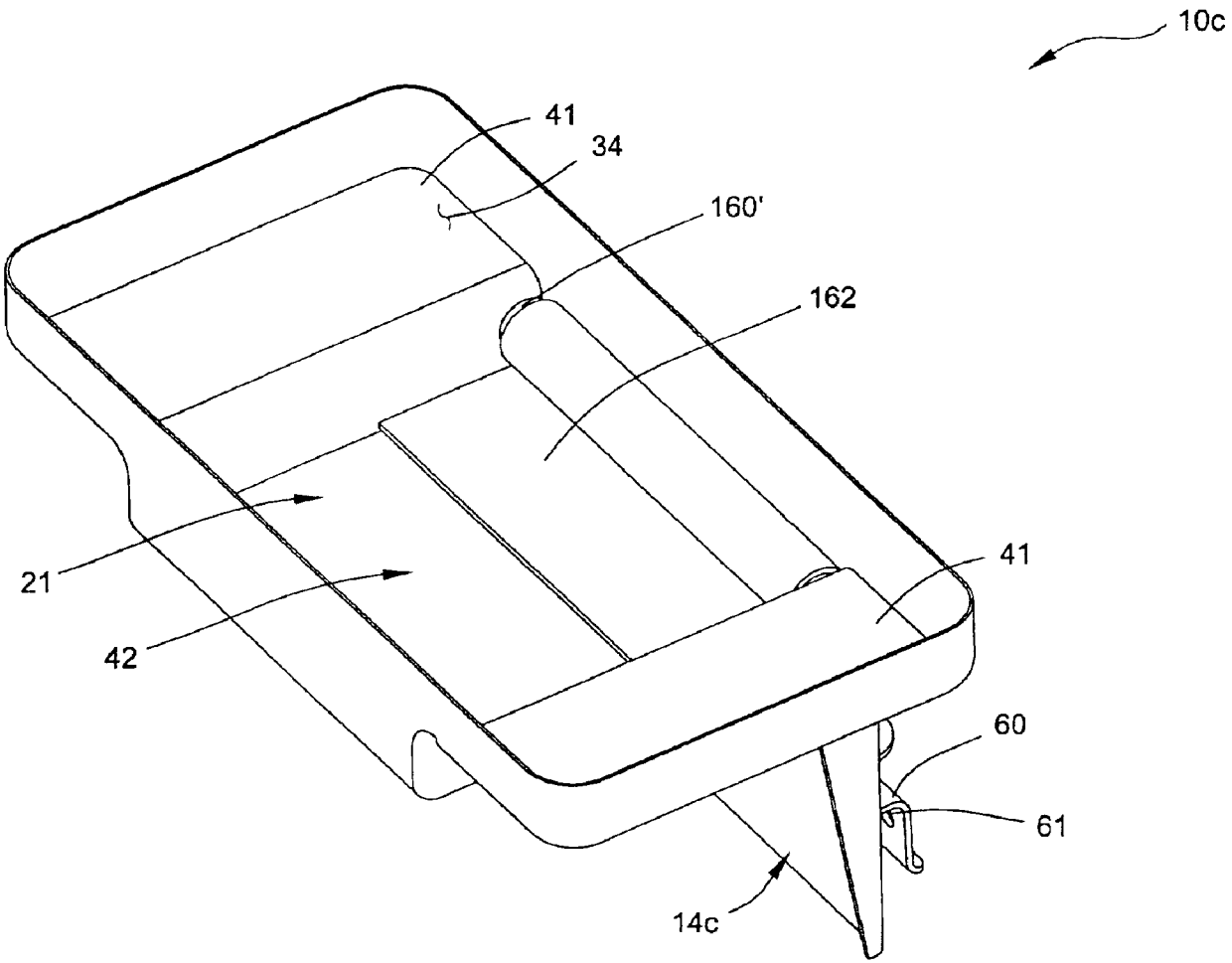
FIG. 12 is a perspective view of the tray assembly of FIG. 11 with part of a housing removed to show a locking mechanism of the tray assembly in an engaged position.

The locking mechanism 16*c* includes the first tube 158 fixedly connected to the tray 12 via an attachment bracket 162 integrally formed with the first tube 158. The first tube 158 includes a pair of L-shaped slots 164 formed on an outer surface of the first tube 158, as best shown in FIG. 11. The L-shaped slots further include a first and second path 165, 167 generally formed perpendicular to each other. The second tube 160 is fixedly attached to the support member 14*c* at each end, whereby the main body of the second tube 160 is disposed within the first tube 158 and is rotatable therein. The second tube 160 further includes a pair of posts 166 fixedly attached to an outer surface of the second tube 160. The posts 166 are received by the L-shaped slots 164 of the first tube 158, whereby the position of the posts 166 within the L-shaped slots 164 governs the position of the tray 12. The posts 166 are biased into engagement with the first paths 165 of the slots 164 due to a spring 168 disposed within the body of the second tube 160. In this manner, the second tube 160 must be translated against the bias of the spring 168 to a point where the posts 166 can engage the second path 167 in order to move the posts 166 along the second paths 167. Alternatively, a third tube 160' could be provided, whereby the second tube 160 is slidably received therein. In this manner, the support member 14*c* is fixedly attached to the third tube 160' for rotation therewith, while the base 20 remains fixedly attached to the first tube 158.

Figure 13:
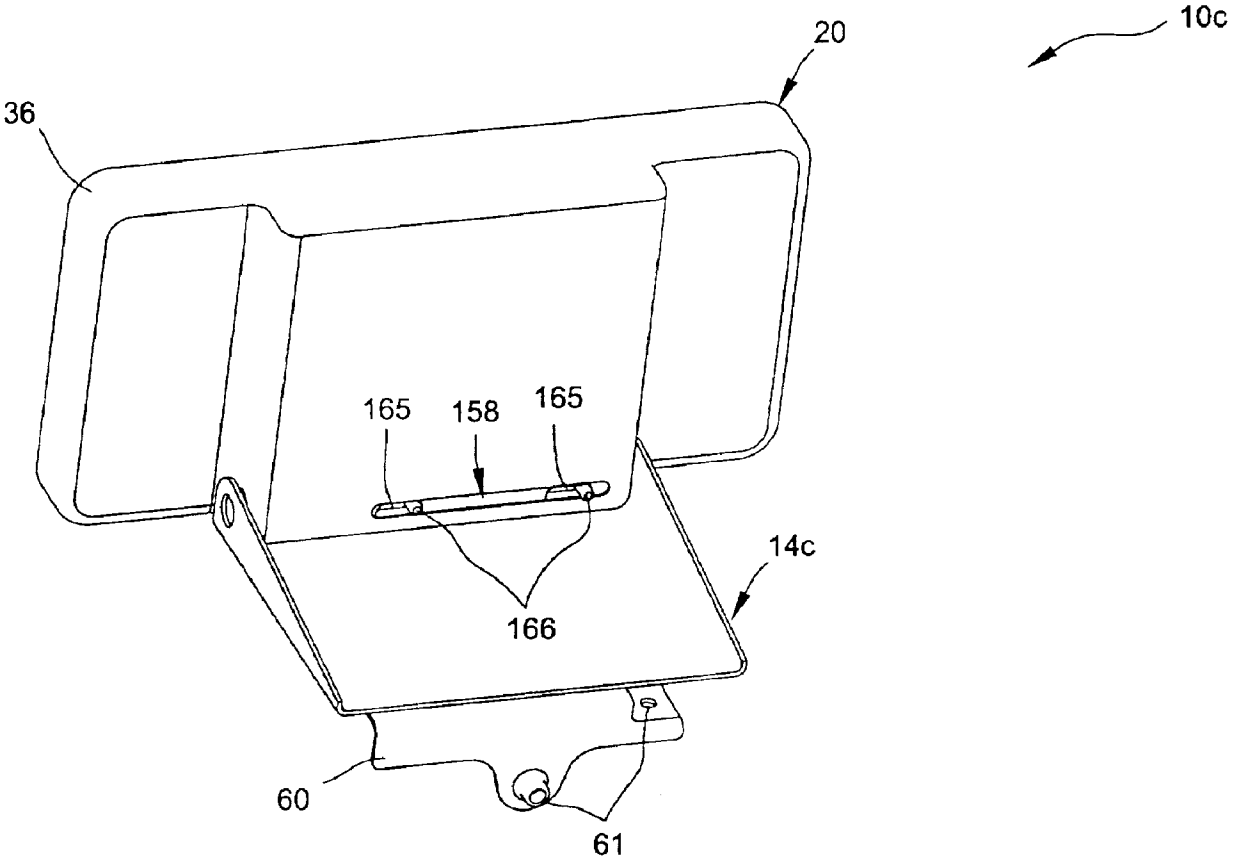
FIG. 13 is a perspective view of the tray assembly of FIG. 11 to show a locking mechanism of the tray assembly in an engaged position.
Figure 14:
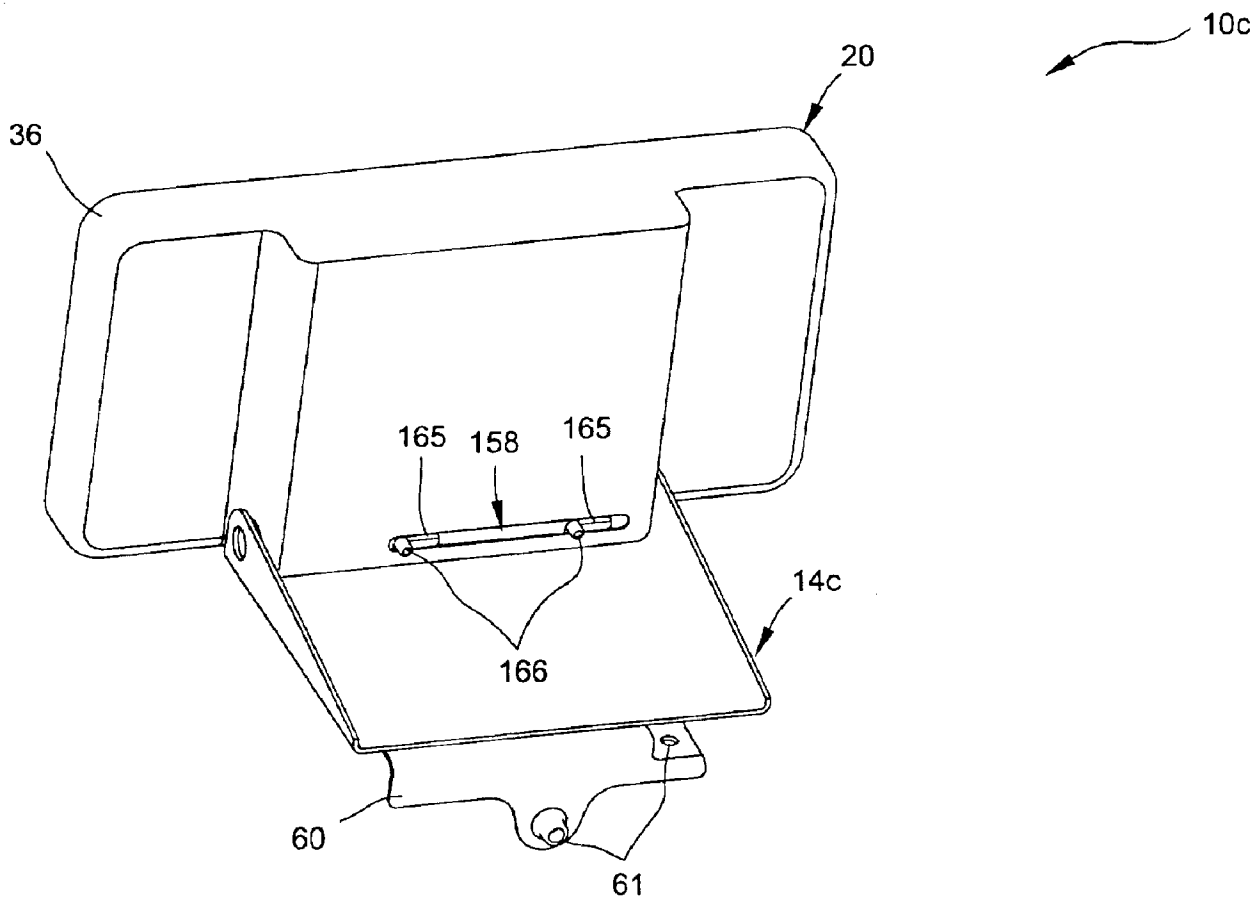
FIG. 14 is a perspective view of the tray assembly of FIG. 11 to show a locking mechanism of the tray assembly in a disengaged position.

With reference to FIGS. 11–14, the operation of the folding tray assembly 10*c* will be described in detail. To release the tray 12 from the use position as shown in FIG. 19, a force is applied to the tray 12 such that the second tube 160 is caused to translate against the bias of the spring 168. Once the tray 12 have been moved a sufficient distance, the posts 166 will have traveled a sufficient distance along the first paths 165 to a point where the posts 166 can then engage the second paths 167 as shown in FIG. 14. At this point, a downward force may be applied to the tray 12 to move the posts 166 along the second path 167. In this manner, the weight of the tray 12 will assist in moving the posts 166 along the second paths 167 due to the gravitational forces exerted on the tray 12. Once the posts 166 have sufficiently moved along the second paths 167 the posts 166 engage the end of the second paths 167 and tray 12 is in the stowed position.

To move the tray 12 to the upright or use position, a force is applied to the tray 12 such that the posts 166 move along the second paths 167 generally toward a point where the first and second paths 165, 167 intersect. Once the posts 166 reach a point where the posts 166 can translate down the first paths 164, the spring 168 will cause the posts 166 to travel along the first path 165 to the point where the posts 166 reach the end of the first path 165. At this point, the tray 12 is locked and returned to its use or upright position as shown in FIG. 13.

In a fifth embodiment as shown in FIGS. 15–18, the tray assembly 10*d* includes the locking mechanism 16*d* having a tube 158*d* in communication with the tray 12 and the support member 14*d*. In view of the substantial similarity in structure and function of the components associated with the folding tray assembly 10 with respect to the folding tray assembly 10*d*, like reference numerals are used hereinafter and in the drawings to identify like components while like reference numerals containing letter extensions are used to identify those components that have been modified.

Figure 15:
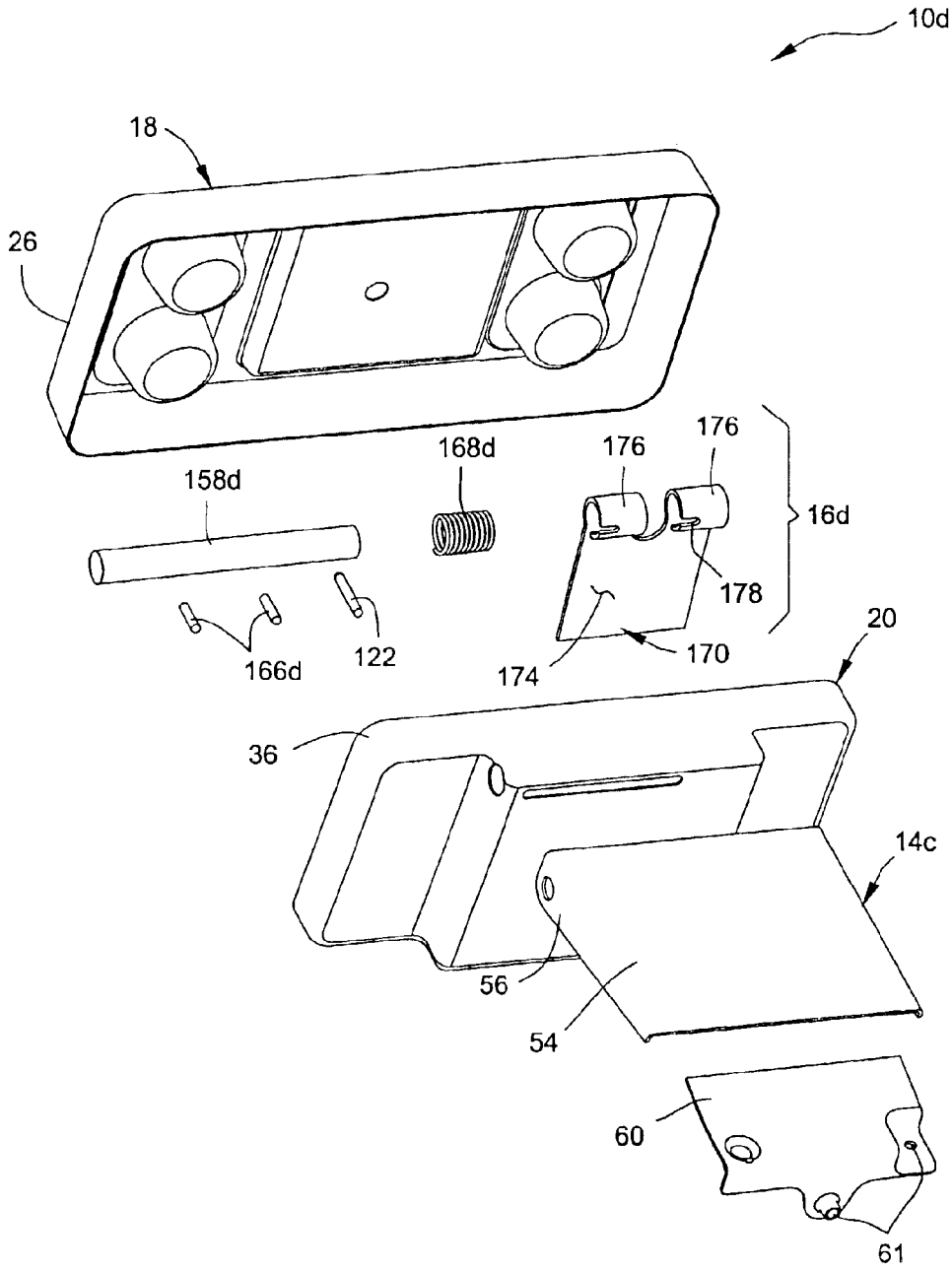
FIG. 15 is an exploded view of a fifth embodiment of a tray assembly in accordance with the principals of the present invention.
Figure 16:
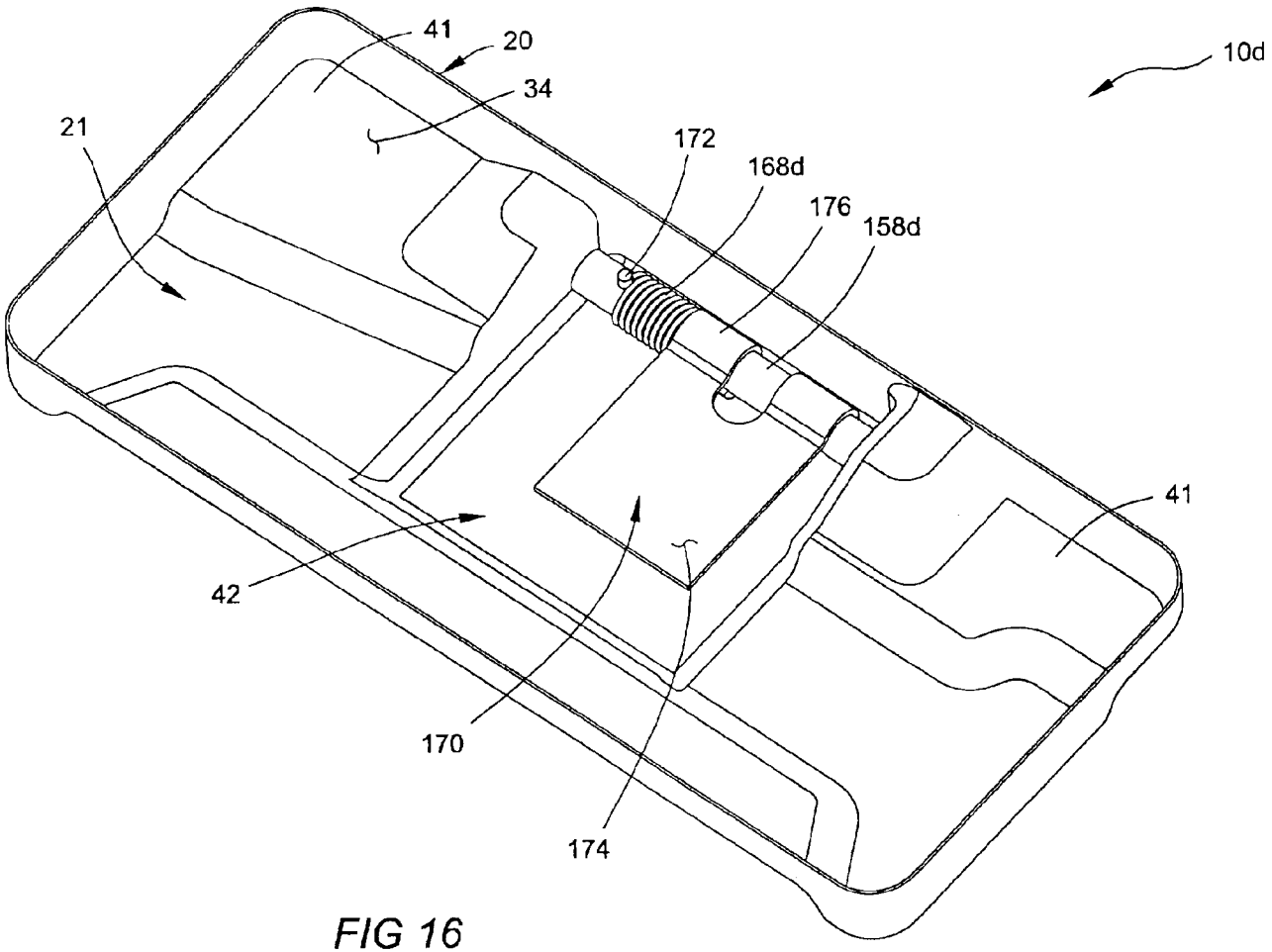
FIG. 16 is a perspective view of the tray assembly of FIG. 15 with part of a housing removed to show a locking mechanism of the tray assembly in an engaged position.

The locking mechanism 16*d* includes the tube 158*d* and an attachment bracket 170. The tube 158*d* is fixedly connected to the support member 14*d* and includes a stake 172 fixedly attached thereto and a pair of posts 166*d*. The posts 166*d* are disposed on an outer surface of the tube 158*d* and are fixedly attached thereto. The attachment bracket 170 includes a mounting surface 174 and a pair of support brackets 176 extending therefrom, as best shown in FIG. 15. The support brackets 176 have a generally cylindrical shape and include a pair of notches 178 for receiving the posts 166*d*, as will be discussed further herein below.

Figure 17:
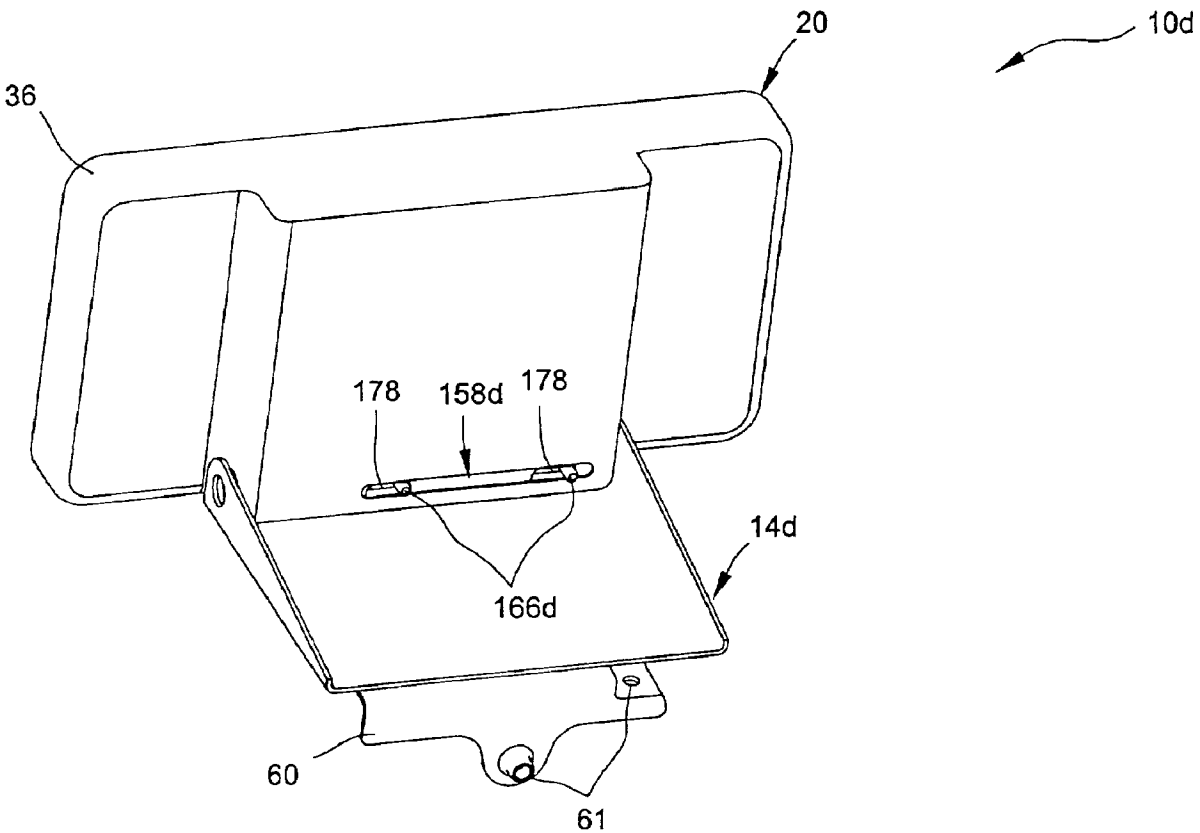
FIG. 17 is a perspective view of the tray assembly of FIG. 15 to show a locking mechanism of the tray assembly in an engaged position.
Figure 18:
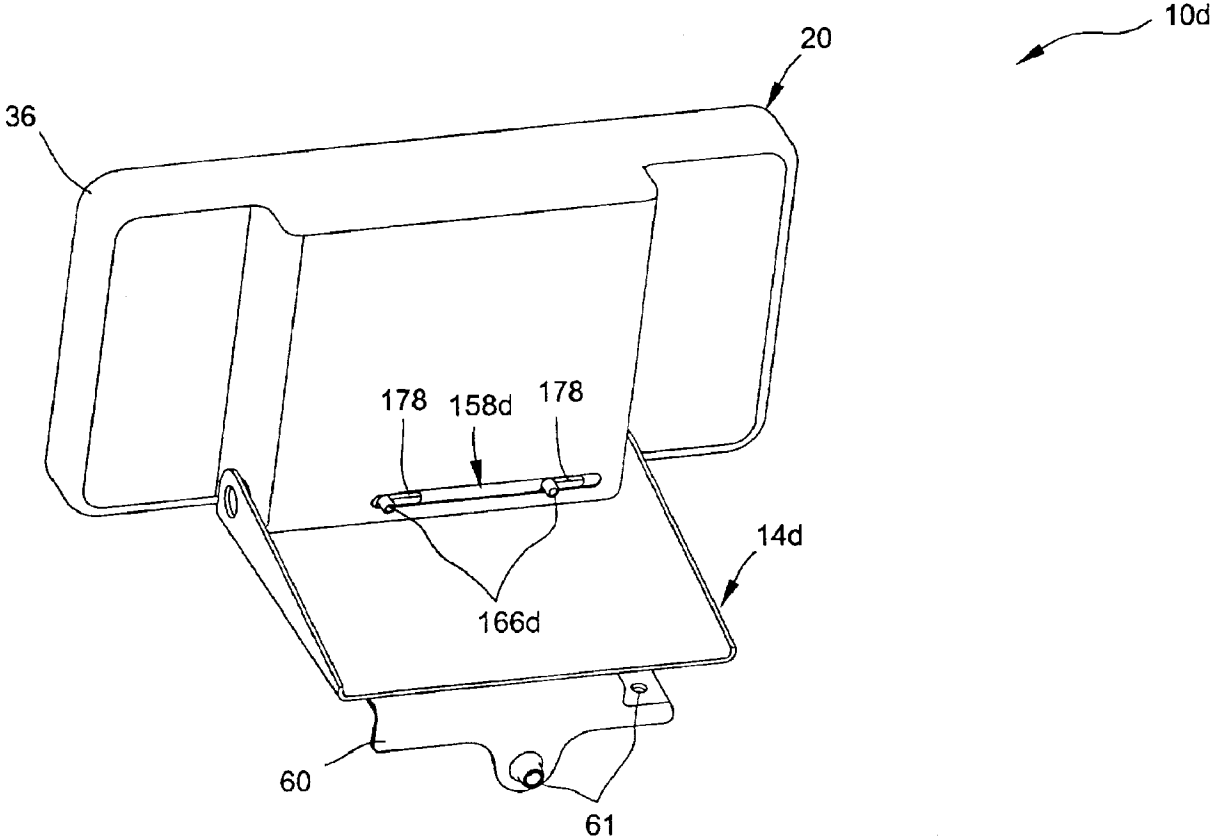
FIG. 18 is a perspective view of the tray assembly of FIG. 15 to show a locking mechanism of the tray assembly in a disengaged position.

The support brackets 176 rotatably receive the tube 158*d*, whereby the posts 166*d* engage the notches 178 of the support brackets 176. The posts 166 are biased into engagement with the notches 178 due to a biasing force exerted thereon by a spring 168*d*. The spring 168*d* is disposed between the posts 166*d* and the stake 172. Specifically, the spring 168*d* is compressed between the stake 172 and an end of the attachment bracket 170 such that a force is exerted on the tube 158*d*. When the posts 166*d* are engaged with the notches 178, the tray 12 is in the upright and use position, as shown in FIG. 17. When the posts 166*d* are disengaged from the notches 178, the tray 12 is freely roatatable relative to the support member 14*d*, as shown in FIG. 18.

It should be understood that both locking mechanisms 16*c* and 16*d* are disposed within the interior space 21 of the tray member 12, generally between the cover 18 and the base 20. In this manner, locking mechanisms 16*c* and 16*d* function between the cover 18 and base 20, such that no moving parts are disposed outside of the tray member 12. In this regard, having locking mechanisms 16*c* and 16*d* disposed within the interior space 21 allows the tray assembly 10 to have a generally L-shape in the use position.

With reference to FIGS. 15–18, the operation of the folding tray assembly 10*d* will be described in detail. To release the tray 12 from the use position as shown in FIG. 19, a force is applied to the tray 12 such that the tube 158*d* is caused to translate within the support brackets 176 against the bias of the spring 168*d*. Once the tray 12 have been moved a sufficient distance, the posts 166*d* will have traveled a sufficient distance along the support brackets 176 to a point where the posts 166*d* disengage the notches 178. At this point, a downward force may be applied to the tray 12 to rotate the tube 158*d* within the support brackets 176. In this manner, the weight of the tray 12 will assist in rotating the tube 158*d* due to the gravitational forces exerted on the tray 12. Once the tube 158 has rotated to a point where the base 20 engages the support member 14*d*, the tray 12 is in the stowed position.

To move the tray 12 to the upright or use position, a force is applied to the tray 12 such that the tube 158*d* again rotated within the support brackets 176 generally moving the posts 166*d* toward engagement with the notches 178. Once the posts 166*s* reach a point where the notches can be engaged, the spring 168*d* will cause the tube 158*d* to push the posts 166*d* into engagement with the notches 178. At this point, the tray 12 is locked and returned to its use or upright position.

Figure 20:
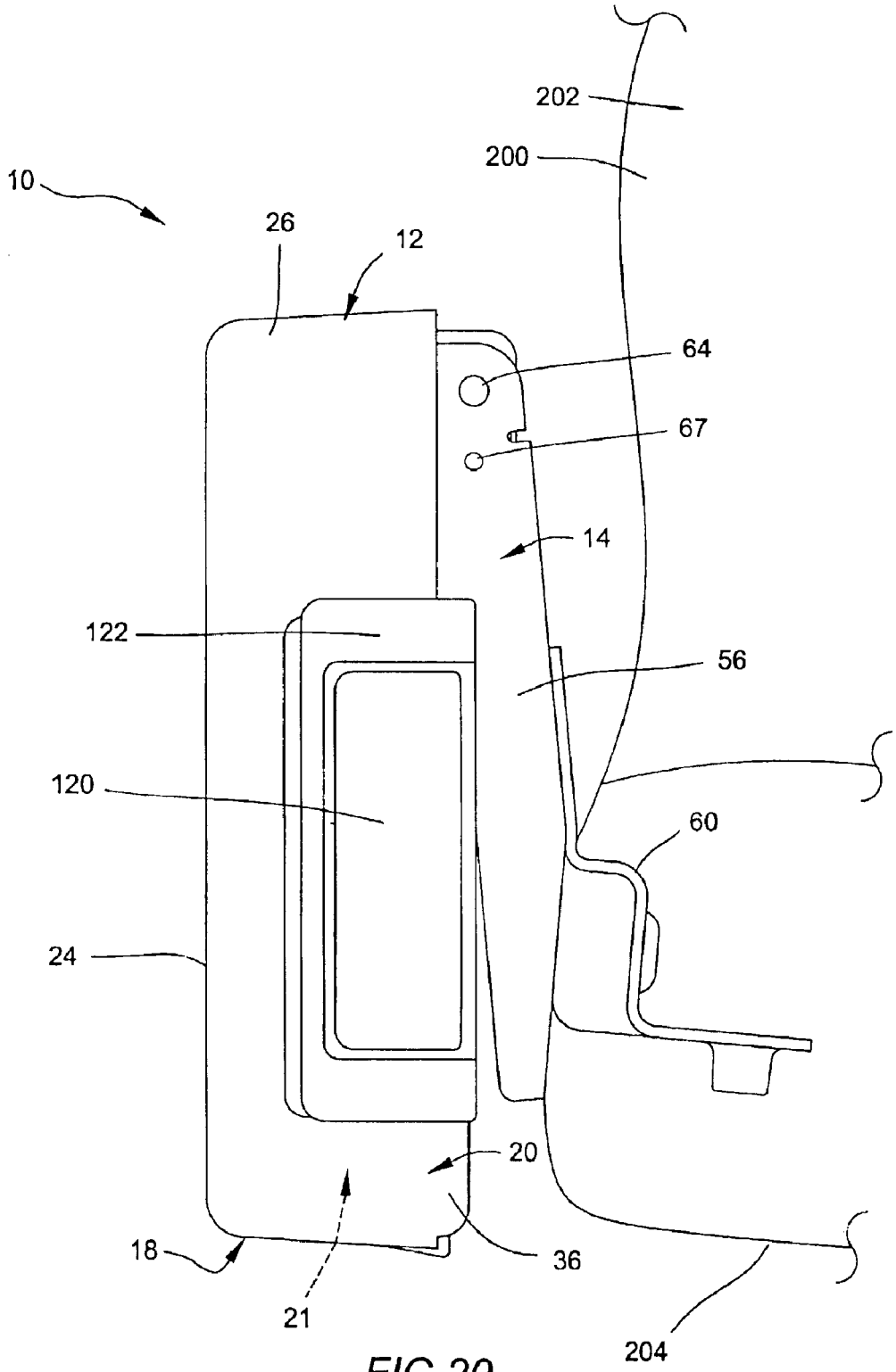
FIG. 20 is a side view of the tray assembly of FIG. 1 attached to a seat in a stowed position.

With reference to FIGS. 19 and 20, the tray assembly 10 is shown attached to a seat 200 having a seatback frame 202 and a seat bottom frame 204. The tray assembly 10 is supported by the seat 200 and is fixedly attached thereto by the support member 14. In this manner, the support member 14 is fixed to the seat 200, while the tray member 12 is permitted to rotate relative the seat 200 and support member 14 to toggle the tray assembly 10 between the stowed and use positions. FIG. 19 shows the tray assembly 10 in the use position, whereby a space is provided under the tray member 12 and adjacent the seat 200 and bracket 14. FIG. 20 shows the tray assembly 10 in a stowed position, whereby the tray member 12 is folded relative the seat 200 and bracket 14 such that the tray member 12 is generally parallel to the bracket 14. It should be understood that while the tray assembly 10 is shown attached to a seat 200, the tray assembly 10 could also be attached to a structure such as a vehicle floor pan or a vehicle frame (neither shown), but is not limited as such.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A tray assembly comprising:

a support member;

a tray pivotably supported by said support member between a use position and a stowed position; and a locking mechanism housed within said tray, said locking mechanism operable to selectively prohibit relative movement between said tray and said support member and comprising at least one axially movable pin selectively engaging said support member to lock said tray in at least one of said use position or said stowed position; and an actuation mechanism housed within said tray, said actuation mechanism operable to selectively actuate said locking mechanism.

2. The tray assembly of claim 1, wherein said tray includes a lower member and an upper member, said lower member operable to support said upper member.

3. The tray assembly of claim 2, wherein said locking mechanism and said actuation mechanism are disposed within a space that is bounded, at least in part, by each of said lower member and said upper member.

4. The tray assembly of claim 1, wherein said locking mechanism comprises a pair of axially movable pins.

5. The tray assembly of claim 4, wherein said locking mechanism further comprises a link, a first cam and a second cam, said link operable to engage said first cam, said first cam operable to engage said second cam, and said second cam operable to toggle said pins between a locked and an unlocked position.

6. The tray assembly of claim 5, wherein said pins are biased into engagement with said support member by a first biasing member.

7. The tray assembly of claim 6, wherein said first biasing member is a spring.

8. The tray assembly of claim 1, wherein said locking mechanism includes a first tube having a first and a second slot formed therein, said first tube being fixedly attached to said tray.

9. The tray assembly of claim 8, wherein said first tube rotatably receives a second tube, said second tube fixedly attached to said support member.

10. The tray assembly of claim 9, wherein said second tube includes a pair of posts fixedly attached to said second tube and received by both said first and second slots of said first tube, said posts moveable between a locked position and an unlocked position within said first and second slots.

11. The tray assembly of claim 10, wherein when said posts are in said locked position said tray is in either said use position or said stowed positions and when said posts are in said unlocked position said tray is in neither said use position or said stowed position.

12. The tray assembly of claim 1, wherein said tray comprises a rigid base member supporting a cover, said base member and said cover cooperating to form said tray.

13. The tray assembly of claim 12, wherein said base member supports said tray when said tray is in said use position.

14. The tray assembly of claim 12, wherein said base member is pivotably connected to said support member at a first side of said tray and is uncontstrained at a second side of said tray.

15. The tray assembly of claim 12, wherein said locking mechanism engages said support member, and said locking and said base member are cooperable to support said tray when said tray is in said use position.

16. The tray assembly of claim 1, wherein said tray includes a first and a second aperture, said first and second apertures operable to allow said locking mechanism to selectively engage said support member.

17. The tray assembly of claim 1, wherein said tray and said support member each generally form one leg of a L-shape when said tray is in said use position so as to provide an open space beneath said tray when the tray is in said use position.

18. The tray assembly of claim 1, wherein said tray is disposed generally parallel and proximate to said support member when said tray is in said stowed position.

19. The tray assembly of claim 1, wherein said locking mechanism is disposed adjacent a first side of said tray.

20. A seat assembly comprising:

a seating surface supported by a frame; and a tray assembly attached to said frame, said tray assembly comprising:

a support member;

a tray member pivotably supported by said support member between a use position and a stowed position;

a locking mechanism housed within said tray member, said locking mechanism comprising at least one movable pin operable to engage said support member and selectively lock said tray member to said support member; and an actuation mechanism housed within said tray member, said actuation mechanism operable to selectively actuate said locking mechanism.

21. The seat assembly of claim 20, wherein said frame comprises a bottom frame and support member is fixedly attached to said bottom frame.

22. The seat assembly of claim 20, wherein said frame comprises a back frame and said support member is fixedly attached to said back frame.

23. The seat assembly of claim 20, wherein said wherein said tray member includes a lower member and an upper member, said lower member and said upper member cooperable to form an interior space of said tray member.

24. The seat assembly of claim 23, wherein said locking mechanism is disposed within said interior space of said tray member.

25. The seat assembly of claim 20, wherein said locking mechanism includes a first tube having a first and second slot formed therein, said first tube being fixedly attached to said tray assembly.

26. The seat assembly of claim 25, wherein said first tube rotatably receives a second tube, said second tube fixedly attached to said support member.

27. The seat assembly of claim 26, wherein said second tube includes a pair of posts fixedly attached to said second tube and received by said fist and second slots of said first tube, said posts moveable within said first and second slots between a locked position prohibiting relative movement between said tray member and said support member and an unlocked position permitting relative movement between said tray member and said support member.

28. The seat assembly of claim 27, wherein when said posts are in said locked position said tray assembly is in either said use position or said stowed positions and when said posts are in said unlocked position said tray assembly is in neither said use position or said stowed position.

29. The seat assembly of claim 20, wherein said locking mechanism includes a pair of axially movable pins, said pins selectively engaging said support member to prohibit relative movement between said tray member and said support member in at least one of said use position or said stowed position.

30. A mechanism for a tray assembly having a working surface that is lockable in both a use position and a stowed position, said mechanism comprising:

a first cam comprising a first ramped surface and second ramped surface, said first cam moveable along a first axis;

a plurality of posts, at least one of said posts engaging said first ramped surface and at least one of said posts engaging said second ramped surface, said posts moveable along a second axis by said main cam between a locked position and a unlocked position such that the posts enable engagement of a support bracket in said locked position and do not enable engagement of said support bracket in said unlocked position;

an actuation mechanism comprising a handle and at least one link, said at least one link engaging said first cam; and wherein the application of a force to said handle causes said first cam to move along said first axis and said plurality of posts to move along said second axis.

31. The tray assembly of claim 30, wherein said posts are biased in said locked position by a first biasing member.

32. The tray assembly of claim 30, wherein said link is pivotably connected to an actuation handle at a first end and to said first cam at a second end.

* * * * *

UNITED STATES PATENT AND TRADEMARK OFFICE

CERTIFICATE OF CORRECTION

PATENT NO. : 6,877,806 B2
DATED : April 12, 2005
INVENTOR(S) : Cutshall et al.

It is certified that error appears in the above-identified patent and that said Letters Patent is hereby corrected as shown below:

Title page,
Item [75], Inventors, the following should be added:
-- John E. Carlson, Fenton Michigan --.

Signed and Sealed this

Twelfth Day of July, 2005

JON W. DUDAS
*Director of the United States Patent and Trademark Office*